US009449513B1

(12) United States Patent
Banuelos

(10) Patent No.: US 9,449,513 B1
(45) Date of Patent: Sep. 20, 2016

(54) PORTABLE TRAFFIC CONTROL SIGNAGE APPARATUS AND METHODS

(71) Applicant: Juan Banuelos, Arcadia, CA (US)

(72) Inventor: Juan Banuelos, Arcadia, CA (US)

( * ) Notice: Subject to any disclaimer, the term of this patent is extended or adjusted under 35 U.S.C. 154(b) by 0 days.

(21) Appl. No.: 14/631,143

(22) Filed: Feb. 25, 2015

Related U.S. Application Data

(63) Continuation-in-part of application No. 14/505,382, filed on Oct. 2, 2014.

(60) Provisional application No. 61/886,057, filed on Oct. 3, 2013.

(51) Int. Cl.

| | |
|---|---|
| ***G08G 1/0955*** | (2006.01) |
| ***G09F 1/06*** | (2006.01) |
| ***G08G 1/00*** | (2006.01) |
| *G09F 15/00* | (2006.01) |
| *G08G 1/07* | (2006.01) |
| *E01F 9/00* | (2016.01) |

(52) U.S. Cl.
CPC ..... *G08G 1/0955* (2013.01); *G08G 1/00* (2013.01); *G09F 1/06* (2013.01); *E01F 9/00* (2013.01); *G08G 1/07* (2013.01); *G09F 15/0056* (2013.01)

(58) Field of Classification Search
None
See application file for complete search history.

(56) References Cited

U.S. PATENT DOCUMENTS 4,152,854 A * 5/1979 Berry, Jr. ..... E01F 9/0126 40/550

* cited by examiner

*Primary Examiner* — Leon-Viet Nguyen
(74) *Attorney, Agent, or Firm* — Barcelo, Harrison & Walker, LLP

(57) ABSTRACT

Traffic signs that facilitate portability are disclosed. In certain embodiments, they are designed to be lighter and have fewer steps involved in their set up, preferably involving only one person. The design of certain embodiments also allows multiple signs to be transported together, and facilitates air flow through the signs. Certain embodiments include generally horizontal panels with breakaway or fracture paths so as to improve crashworthiness and safety of the traffic sign.

1 Claim, 36 Drawing Sheets

FIG. 1A
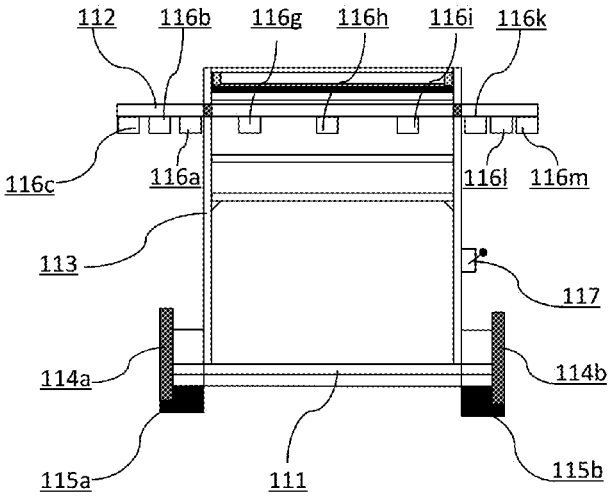
FIG. 1B
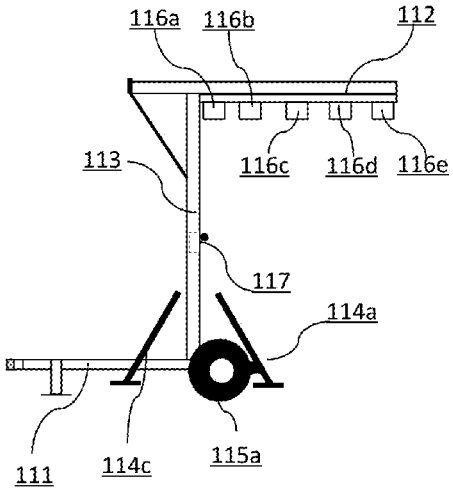
FIG. 1
PRIOR ART

PRIOR ART

FIG. 3A
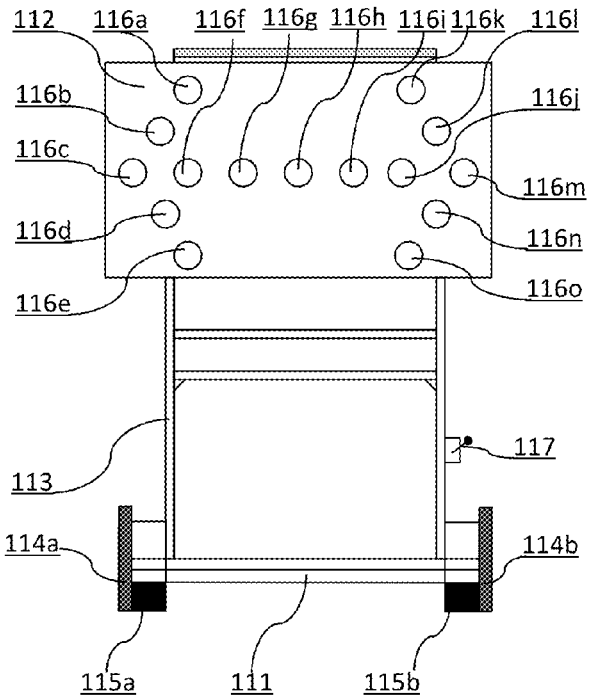
FIG. 3B
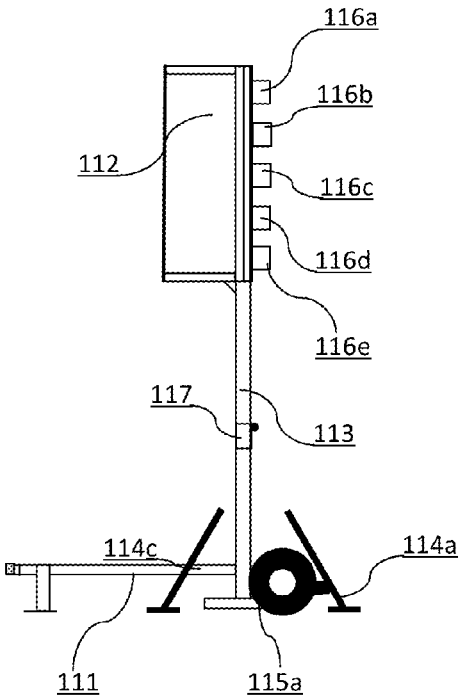
FIG. 3
PRIOR ART

FIG. 4A
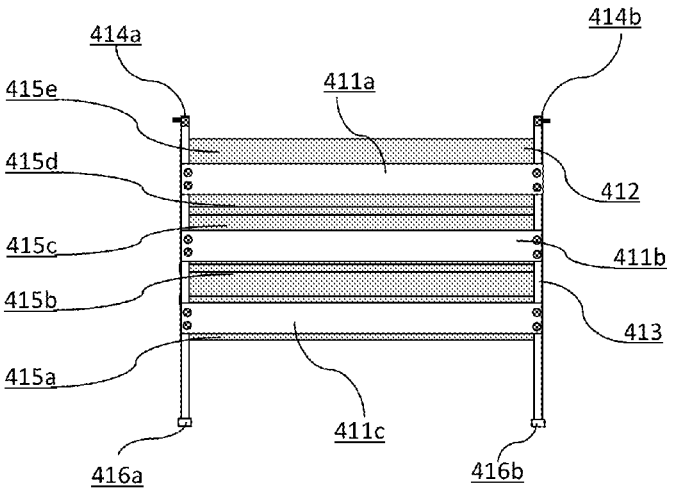
FIG. 4B
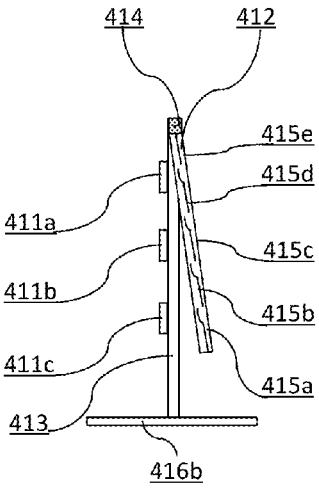
FIG. 4

FIG. 6A
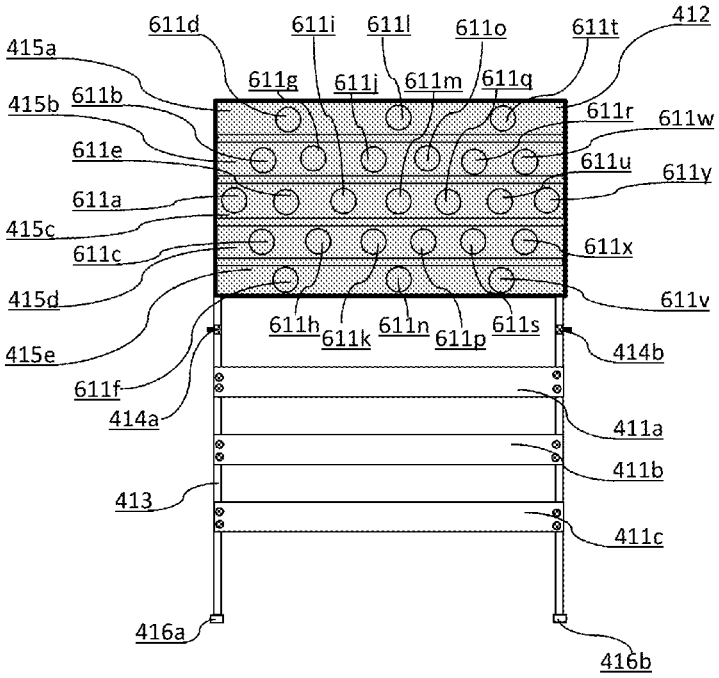
FIG. 6B
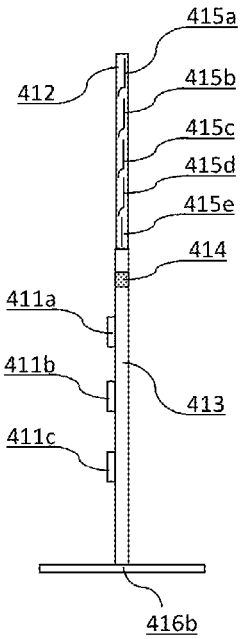
FIG. 6

FIG. 11A
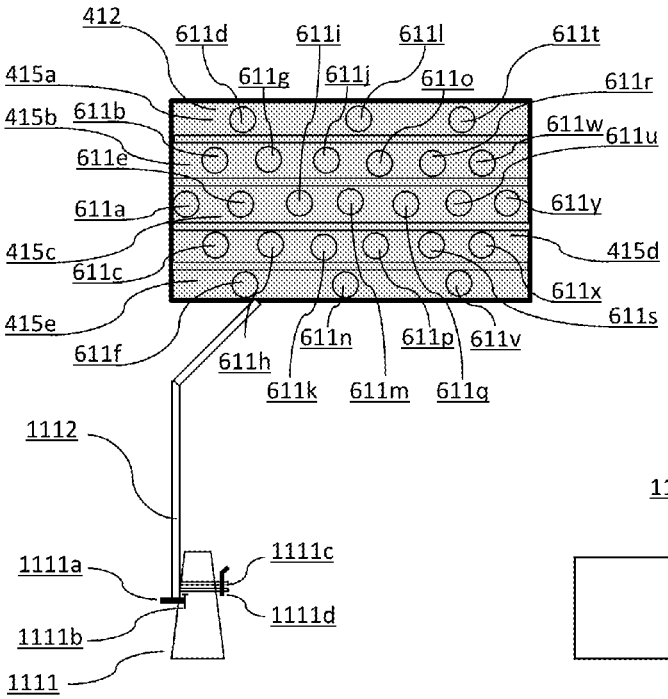
FIG. 11B
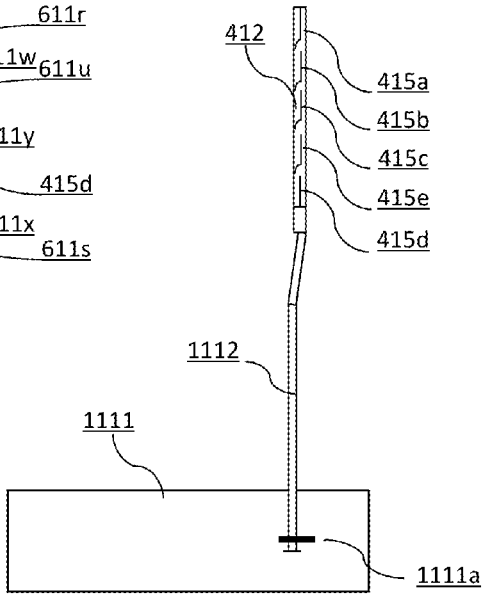
FIG. 11

FIG. 19A
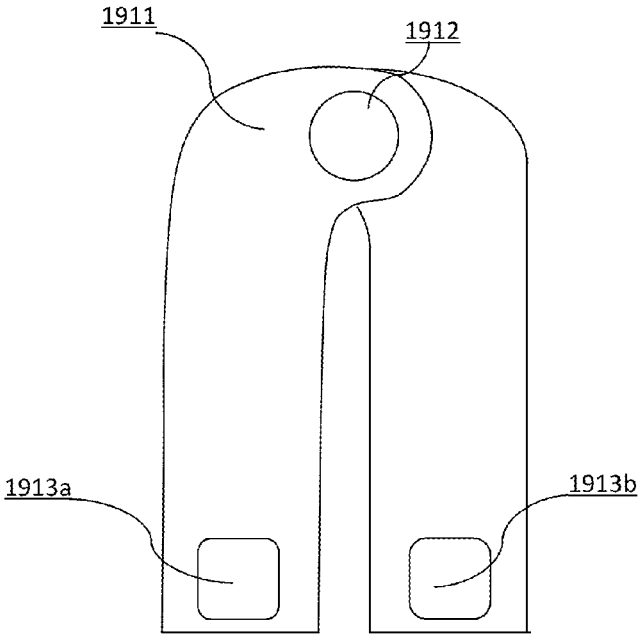
FIG. 19B
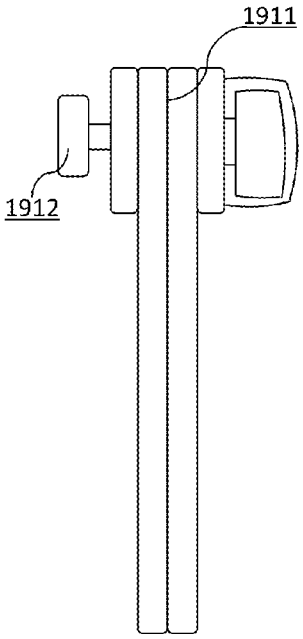
FIG. 19
PRIOR ART

FIG. 20A
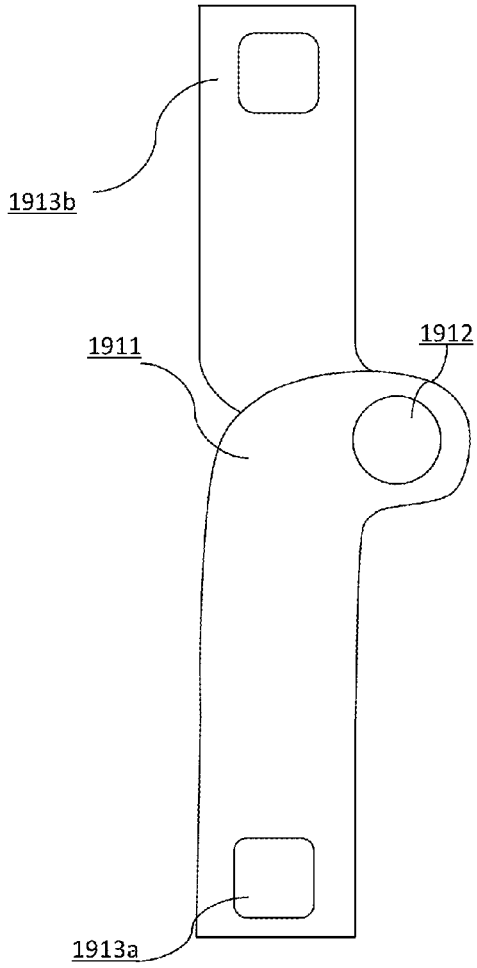
FIG. 20B
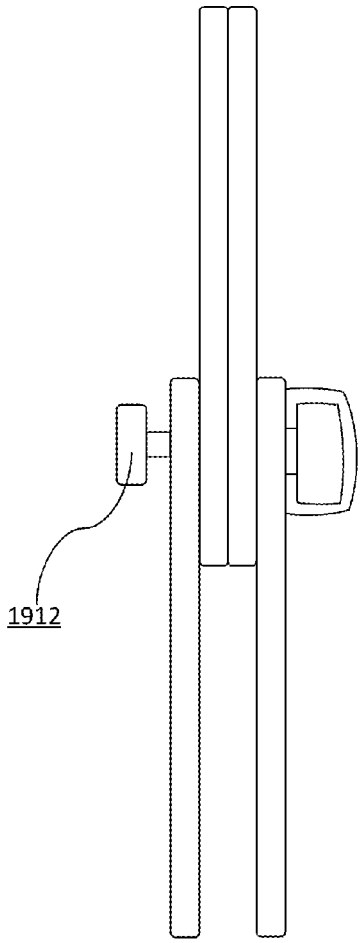
FIG. 20 PRIOR ART

FIG. 21
FIG. 21A
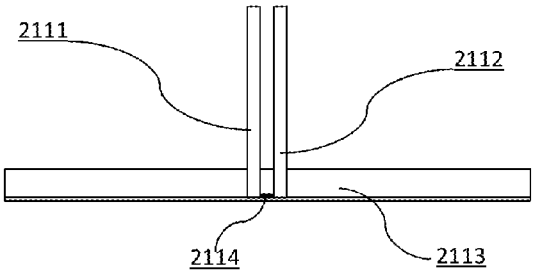
FIG. 21B
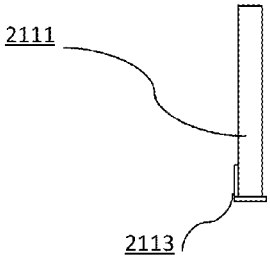

PORTABLE TRAFFIC CONTROL SIGNAGE APPARATUS AND METHODS

CROSS-REFERENCE TO RELATED APPLICATIONS

This application is a continuation-in-part of U.S. patent application Ser. No. 14/505,382, filed Oct. 2, 2014, which claims the benefit of U.S. Provisional Patent Application No. 61/886,057, entitled "Portable Traffic Control Signage Apparatus and Methods" (filed Oct. 3, 2013). The entirety of the foregoing patent applications is incorporated by reference herein for all purposes.

BACKGROUND OF THE DISCLOSURE

1. Field of the Disclosure

This invention generally relates to traffic signs, and more specifically to traffic signs that facilitate portability.

2. General Background

Various portable traffic signs exist to provide warning and directional information to drivers. Typically, such signs are quite heavy, mounted on a trailer, somewhat cumbersome to move, and often require several steps to set up. When trailers are used, they are typically attached to a truck or other vehicle that transports the traffic sign to the desired location. Furthermore, typically at least two people are required in setting up the traffic sign.

Current traffic signs known to those having skill in the art furthermore can normally be transported only one at a time. Occasionally, two trailers may be transported together by a single vehicle, but this becomes rather problematic if the driver should attempt to back up, and can become dangerous at highway speeds. If the driver overshoots the desired location for the traffic sign, this impairment for backing up creates further difficult work for the people placing the sign.

Thus, there exists a need for traffic signs that address the limitations of currently known solutions.

BRIEF DESCRIPTION OF THE DRAWINGS

By way of example, reference will now be made to the accompanying drawings, which are not to scale.

FIG. 1 illustrates aspects of the prior art, with a front and side view of an arrow board trailer, folded for travel or storage purposes.

FIG. 3 illustrates aspects of the prior art, with a front and side view of an arrow board trailer, deployed for flashing arrow sign display.

FIG. 4 depicts a front and side view of a portable arrow board, and its relevant components, folded down for travel or storage purposes, according to aspects of the present invention.

FIG. 6 depicts a front and side view of a portable arrow board sign, and its relevant components, deployed for flashing arrow sign display, according to aspects of the present invention.

FIG. 11 depicts a front and side view of a portable arrow board, and its relevant components, deployed for flashing arrow sign display, fixed to a standard concrete barrier, according to aspects of the present invention.

FIG. 19 illustrates a front and side view of a locking device mechanism, used for the opening and closing of the flashing arrow board according to aspects of the present invention, closed for travel or storage purposes.

FIG. 20 illustrates a front and side view of a locking device mechanism, used for the opening and closing of the flashing arrow board according to aspects of the present invention, deployed for flashing arrow sign display.

FIG. 21 depicts a front and side view of a footing bracket used for portable traffic signs, according to aspects of the present invention.

DETAILED DESCRIPTION

Figure 2:
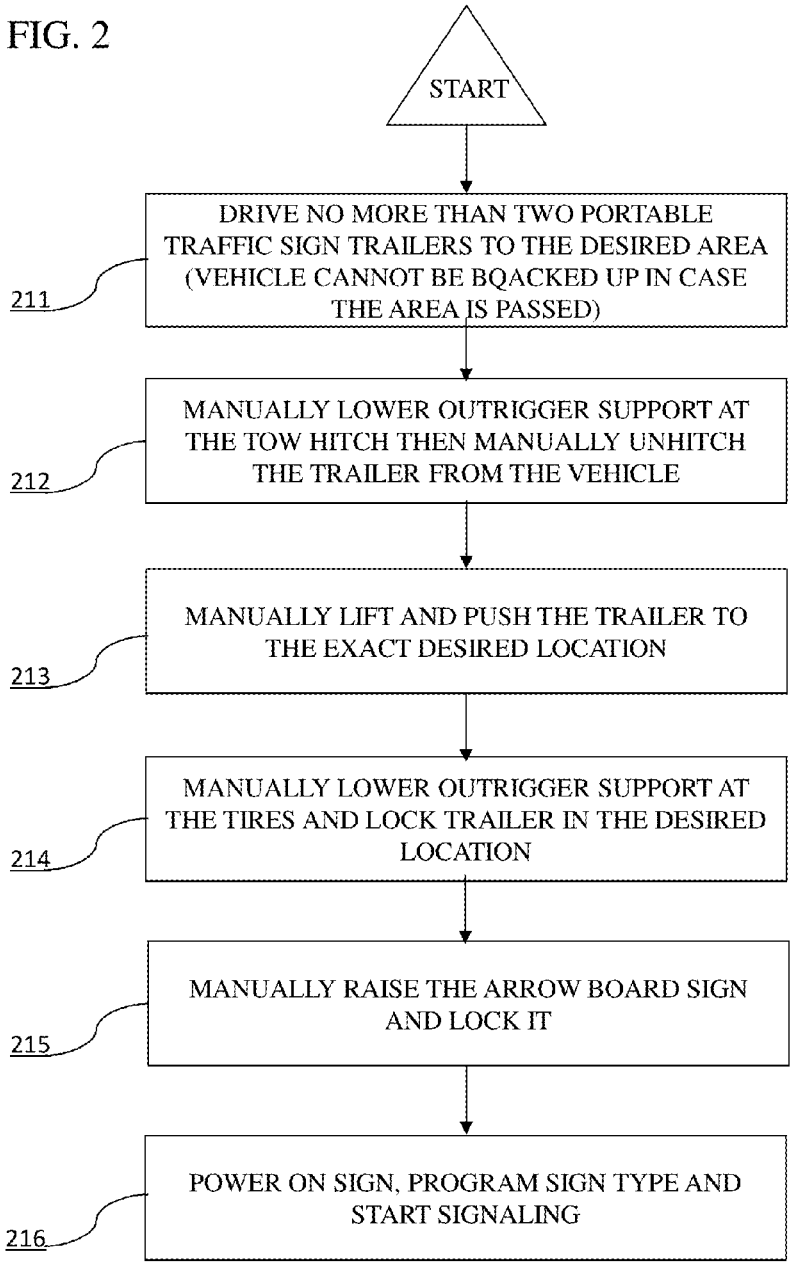
FIG. 2 depicts a flow chart illustrating the method for setting up the existing arrow board trailer.

Those of ordinary skill in the art will realize that the following description of the present invention is illustrative only and not in any way limiting. Other embodiments of the invention will readily suggest themselves to such skilled persons, having the benefit of this disclosure. Reference will now be made in detail to specific implementations of the present invention as illustrated in the accompanying drawings. The same reference numbers will be used throughout the drawings and the following description to refer to the same or like parts.

FIG. 1 illustrates aspects of the existing prior art of the trailer 111 with holds the arrow board 112, which is folded parallel to the ground for travel or storage purposes. FIG. 1A illustrates aspects of the prior art with a front view of the trailer 111, a front view of the support frame 113, and a front view of the arrow board 112 facing downwards. On the arrow board 112, the sides of nine of the lights 116 on arrow board 112 are visible from the front view, although more lights 116 exist on the arrow board 112. The two wheels 115 allow for the trailer 111 to be transported and, if necessary, pushed by hand to the exact location. Connected to the wheels 115 are four stands 114, although only two are visible in this view. The other two stands 114 are behind the wheels 115. These stands 114 are pulled up so that trailer 111 can be moved or transported. The handle 117 on the side of support frame 113 is necessary for unfolding the arrow board 112 to its deployed position. FIG. 1B illustrates aspects of the existing prior art with a side view of the trailer 111, a side view of the frame 113 with handle 117 attached, and a side view of the arrow board 112, folded parallel to the ground for travel purposes. Five of lights 116 on the arrow board 112 are visible in this side view. Wheel 115 for moving and transporting the arrow board 112 is visible in this side view. Two of the four stands 114 are also visible in the side view but up and not being used when the trailer 111 is being moved or transported. There are a total of four stands 114 although only two are visible in each view.

One method often used for transporting exemplary prior art devices is illustrated in FIG. 2. Generally, only one traffic sign may be transported at a time. In step 211, a vehicle, usually a truck, drives the sign close to the desired location. The traffic sign is hitched to the back of the truck or other vehicle. If more than a single sign is attached, maneuvers such as backing up may become more difficult and dangerous. In step 212, the trailer 111 is unhitched from the vehicle, usually by at least two people due to weight and the inherent nature of trailers. In step 213, the trailer 111 is pushed to the desired location, usually done by at least two people. Since it is difficult for a vehicle with a trailer 111 attached to back up, the crew may need to push it manually if the driver passed the location. In step 214, they lock the trailer 111 into the desired location by placing down the four footings 114. Next, in step 215, they use handle 117 to raise the arrow board 112 to its deployed position. A pin may be required to secure it. If the sign is not to be immediately used, they then generally program diamonds (hazard warning light pattern) in as the temporary function until they are ready to use it. When the sign is about to be used, they proceed with step 216 and power the sign with the desired function so it can start signaling the correct direction.

FIG. 3 illustrates aspects of the existing prior art of a deployed flashing arrow board sign. FIG. 3A illustrates aspects of the existing prior art with a front view of the trailer 111, a front view of the support frame 113, and a front view of the arrow board 112, deployed for flashing arrow sign display. Fifteen lights 116 are configured on the arrow board 112. Sometimes these lights 116 may be configured as a horizontal line with arrows at either end, which is the configuration they are in FIG. 3A. In other embodiments, they may be configured into three equilateral diamonds or other similar configurations that may be necessary. The handle 117 on the frame 113 is necessary for unfolding the sign to the working position in FIG. 3A and for folding it down again. FIG. 3A also includes wheels 115 with two stands 114 set down in front of them to secure the trailer 111 in the desired location. Two additional stands 114 to stabilize the sign are located on the opposite side. FIG. 3B depicts aspects of the existing prior art with a side view of the trailer 111, a side view of the support frame 113 with handle 117 attached on the side. The side view also illustrates the side of arrow board 112 that is deployed for flashing arrow sign display. Five of the lights 116 are visible on arrow board 112. Two of the four stands 114 which secure the trailer 111 in the desired location are visible in this view.

According to aspects of the present invention, traffic signs are provided that facilitate portability. In certain embodiments, they are designed to be lighter and have fewer steps involved in their set up, preferably involving only one person. The design of certain embodiments also allows multiple signs to be transported together, and facilitates air flow through the signs.

One embodiment is depicted in FIG. 4, in its closed position. FIG. 4A includes a front view that depicts a "type 3 barricade" configured with a flashing arrow board sign 412 folded down behind the type 3 barricade for travel or storage purposes. Type 3 barricades are commonly known in the art and used as traffic signs, but are generally used to block off an area or give other similar warnings rather than as a component of a flashing arrow board sign. As shown in the example of FIG. 4A, the type 3 barricade consists of three horizontal panels 411, which are made of plywood, metal, or plastic. Each panel 411 has reflective sheeting, and the ends of each panel 411 are bolted to either end of the support frame 413. The reflective sheeting enhances visibility, for traffic delineation purposes. The bottom ends of the support frame 413 connect to the feet 416 that stabilize them and hold them in the desired location. In this embodiment, the feet 416 and support frame 413 are made of aluminum. In one embodiment of the feet 416, they are rectangular prisms that the bottom ends of the support frame 413 can be slid into during set-up. In another embodiment, they have the same overall appearance, but with strategically positioned slots that allow it to "breakaway" "fracture" when encountering a significant force in case of an accident. The flashing arrow board sign 412 is locked into its travel and storage position by the two locking devices 414 in FIG. 4A, and is essentially perpendicular to the ground and is facing away from the barricade. The locking devices 414 are positioned near the top of the support frame 413 on either side of the support frame 413 in this embodiment and are locked in their closed position when the sign is in its storage or travel position. A few of the five arrow board panels 415 with air vents between them are visible on the back of the arrow board 412 behind the type 3 barricade. FIG. 4B depicts a side view which includes the arrow board 412 connected to the top of support frame 413 and folded down behind it in its travelling or storage position with the sides of five panels 415 visible. The five panels 415 and the four air vents in between them are visible. The design of certain embodiments allows for multiple portable traffic signs to be transported simultaneously, depending on the size of the vehicle used to transport them.

Figure 5:
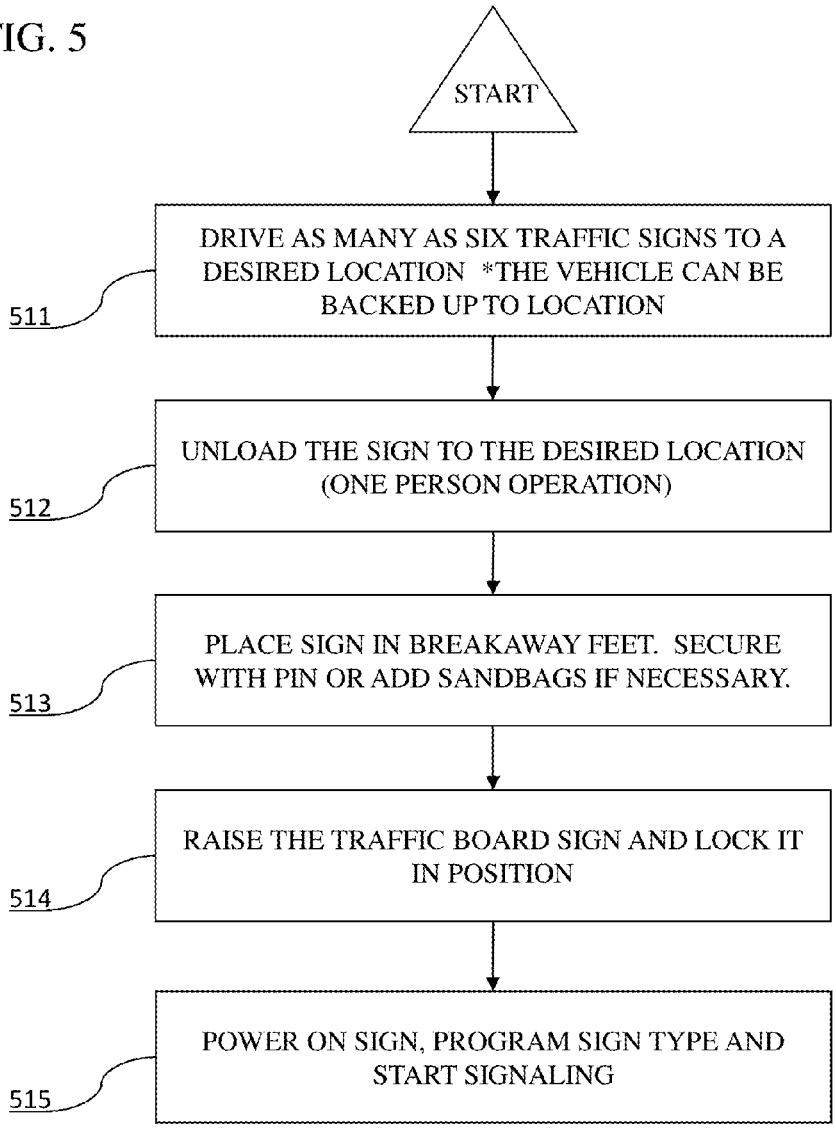
FIG. 5 depicts a flow chart illustrating the method for setting up the portable arrow board of FIG. 4.

A flow chart depicting an exemplary method for the transportation and set-up of the arrow board 412 and the type 3 barricade for certain embodiments is depicted in FIG. 5. In step 511, the sign and its components are transported by a vehicle, generally towed by a truck, to the desired position. The design of the signs allows multiple units to be transported simultaneously. In this embodiment, the sign is on or in the truck or vehicle, instead of being hitched to the back of the vehicle and pulled. While being transported, the sign is in a folded position as shown in FIG. 4, and is unconnected to the feet 416. In step 512, only one person is necessary for unloading the sign and placing it in the desired location. The design of this embodiment allows a driver to back up if needed, so the distance from the truck to the desired location is unlikely to be far. In step 513, the two bottom ends of the support frame 413 of the type 3 barricade are then inserted into the two feet 416. Predetermined spacers may be used to measure the appropriate distance for the feet 416 to be placed from each other but are not necessary. The weight of the sign is high enough so that its weight is sufficient to lock it into the feet 416. The dimensions and the weight of the feet 416 are capable of holding this embodiment of the portable traffic sign in the desired positions under most normal conditions without the need for additional fixtures or fasteners. However, additional locking pins and extra weight can also be used to keep the sign steady in case of high wind load or other similar conditions that may make such supplements necessary. When the sign is folded down and stowed into its storage or travel position (as shown in FIG. 4), only the three reflective panels 411 on the type 3 barricade can be easily perceived by an observer/driver on the road. The sign then acts as a typical type 3 barricade. Generally, the sign remains in this folded position until it is needed. Step 514 occurs when the sign is ready to be used. The arrow board 412 sign is rotated essentially 180 degrees upwards to its fully deployed position. In step 515, the sign is turned on and programed to the desired function to start signaling.

FIG. 6 depicts two views of the embodiment of FIG. 4, where the sign is opened in its fully deployed position. FIG. 6A depicts a front view in which the flashing arrow board 412 has been rotated upwards, to essentially 180 degrees. The arrow board 412 is facing forward and is perpendicular to the ground. The board 412 is locked into position by the two locking devices 414 that are located near the top of the support frame 413 on either side, and deployed for flashing arrow sign display with twenty-four lights 611 in a configuration consisting of three connected, equilateral diamonds. There are five rows and thirteen columns of lights 611 with varying amounts of lights in each row and column. Other configurations of the lights 611 and other quantities of lights 611 are possible. The five panels 415 on the arrow board 412 are separated by four air vents on the arrow board 412, although additional or fewer panels 415 and thus air vents may be included when necessary. These air vents mitigate wind loading in adverse weather conditions as well as help to maintain the stability and lifetime of the sign in normal wind conditions. The support frame 413 is connected to the feet 416 which secure the sign in its desired location. FIG. 6B illustrates a side view of the embodiment of FIG. 4 now fully deployed. The five arrow board panels 415 with air vents to facilitate air flow between each are visible on the side of the arrow board 412. The sides of the three barricade panels 411 are bolted or welded to the support frame 413 on each end of the panel. The bottom ends of the support frame 413 are inserted into the two feet 416.

Figure 7:
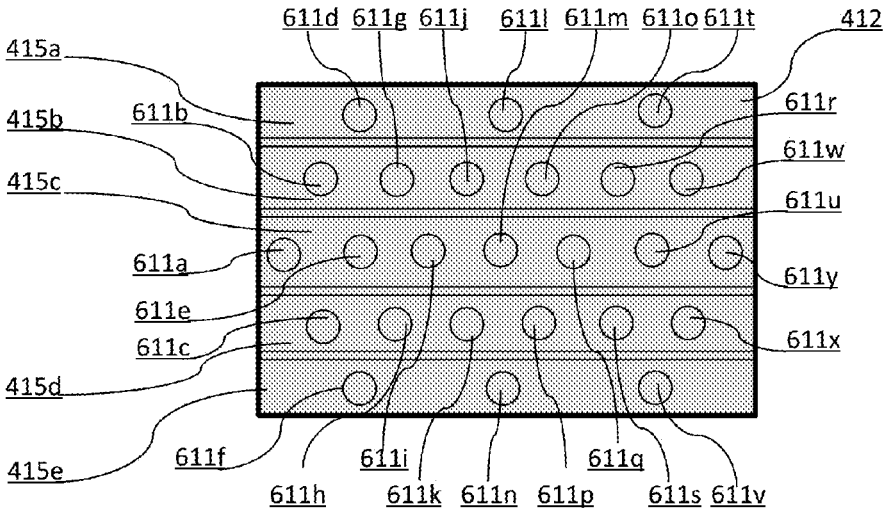
FIG. 7 depicts a front view of a flashing arrow board, and its relevant components according to aspects of the present invention.

FIG. 7 depicts a closer look at the flashing arrow board 412 according to aspects of an embodiment. The five panels 415 on the flashing arrow sign 412 are configured with an air vent between each panel 415. Although the air flow configuration of the panels 415 and the vents between them are depicted in FIG. 7 as being horizontal with each one stacked on top of each other, the air flow configuration can be oriented at any suitable angle. The arrow board 412 has the general appearance of a traditional traffic sign to an observer at a distance because the air vents and panels 415 may not be perceivable at a distance and may then instead appear to be a solid black rectangle. The air flow configuration is measured to be at the point where light can no longer penetrate through the sign from the other side. In an embodiment where the arrow board sign 412 has five panels 415 such as in the embodiment depicted in FIG. 7, there are four air vents. In other embodiments, the air vents may be configured with different number of air vents and panels 415 may be configured on the arrow board 412. Generally, the number of air vents is one less than the number of panels 415 on the arrow board 412. In this embodiment, the lights 611 are configured into three equilateral diamonds. There are five rows of lights 611 and thirteen columns of lights 611, with varying amounts of lights 611 in each. Other configurations of lights 611 are also possible, including, but not limited to, the configuration of lights 611 depicted in FIG. 3 where they are configured as a line with arrows on either end.

Figure 8:
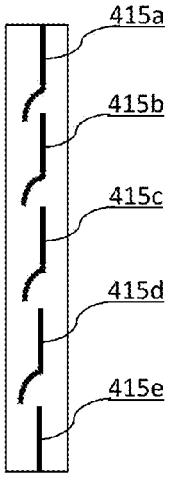
FIG. 8 depicts a side view of a flashing arrow board, showing the design of the board elements according to aspects of the present invention.

FIG. 8 depicts a closer side view of the air vents on the side of the flashing arrow board 412. This is one embodiment of the air flow configuration, but the air flow configuration may vary, depending on the requirements of each particular implementation. The air vents allow air to flow freely through the sign in order to mitigate wind loading in adverse weather conditions as well as help to maintain the stability and lifetime of the sign in normal wind conditions by reducing fatigue on the frame. The air vent configurations are not limited to traffic signs such as the ones depicted in these figures. The air vents configurations may also be applied to other road signs, such as exit signs. Generally, these solid road signs must all be removed together when any one of the signs is no longer acceptably reflective. The air flow configuration such as the one in FIG. 8 allow workers to remove signs one at a time so as to decrease the labor in taking down the signs and the cost of replacing multiple signs. This furthermore decreases the length the pole must be put inserted into the ground necessary for supporting standard signs. This allows less material to be used in constructing the support pole, which decreases its cost and weight. When air vents are used for road signs, they may be positioned to any suitable angle and have any number of vents and panels 415.

Figure 9:
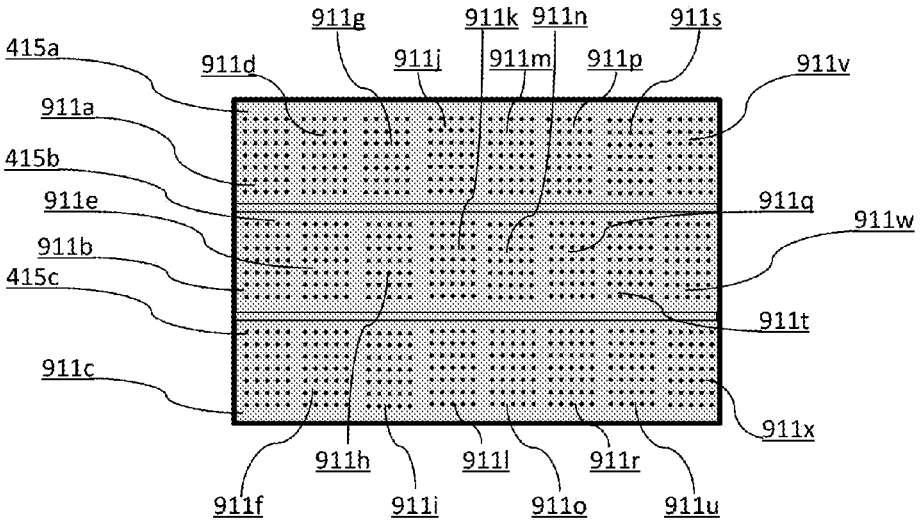
FIG. 9 depicts a front view of a portable changeable message sign, and its relevant components according to aspects of the present invention.

FIG. 9 depicts the board, according to aspects of the present invention, as a portable changeable message sign, or a "PCMS" as it is commonly called. A "PCMS" is generally used for displaying messages with pertinent information to the drivers. Some examples of messages they may display include "Construction ahead", "Be prepared to stop", or "Bridge closed ahead." In this embodiment, there are three panels 415 with one air vent in between each of them, but more or less panels 415 with more or less air vent between them may also be possible. Other embodiments are possible, including but not limited to the vents being configured at any other suitable angle. The lights are configured into rectangular groups 911. There are eight groups 911 of light per panel 415 in this embodiment. The groups 911 of lights in FIG. 9 include seven rows and five columns of lights each, but other configurations are possible. Generally, each group 911 of lights on the "PCMS" can be used to create one letter of the message. Similar to the flashing arrow board, the "PCMS" board has the general appearance of a rectangle. The sign may look very similar to a traditional "PCMS" to an observer at a distance. The panels 415 are measured so that light from behind the sign cannot penetrate to the front and confuse drivers. In some embodiments, the "PCMS" may be supported by the same support frame 413 and may be held by the same feet 416 as the arrow board sign 412 and may therefore follow the same steps in FIG. 5 for its transportation and set-up, but other forms of support may also be used with different steps for the set-up in other embodiments.

Figure 10:
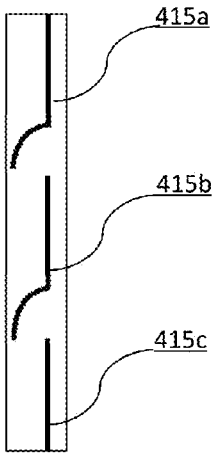
FIG. 10 depicts a side view of a portable changeable message sign, showing the design of the board elements according to aspects of the present invention.

FIG. 10 depicts a closer side view of the air vents of FIG. 9. In this embodiment, there are two air vents because there are three panels 415 on the board, but other configurations are possible based on the requirements of each particular implementation. Generally, the number of vents is one less than the number of panels 415. The vents may furthermore be positioned to any suitable angle. The air vents between the panels 415 allows air to flow freely through the sign in order to mitigate wind loading in adverse weather conditions as well as help to maintain the stability and lifetime of the sign in normal wind conditions by reducing fatigue on the frame.

FIG. 11 depicts another embodiment in which the arrow board 412 is supported only from one side by stand 1112 and utilizes an industry standard Concrete Temporary Railing (Type K) 1111, which is typically seen on roads, to secure it in the desired location. This embodiment is designed to require only one person for set up. Although FIG. 8 is depicted with the arrow board sign 412 of FIGS. 4, 6, 7, and 8 as the board being supported, other boards, including but not limited to the one in FIGS. 9 and 10, may also use this embodiment as their support. However, this support may not be strong enough to safely hold arrow boards in certain embodiments without the characteristic air flow configuration according to aspects of the present invention. The stand 1112 consists of one support leg on the left side that is of a thicker gauge than the sides of the support frame 413 in the embodiment depicted in FIGS. 4 and 6.

Located at the bottom of the stand 1112 is a bracket plate 1111*a*, which corresponds to a standard flat anchoring slot section found in all Concrete Temporary Railing (Type K) Barriers 1111. This plate 111*a* has two holes which allow for pin 1111*b* to be inserted securing the position of the stand. The stand 1112 has a protruding anchor 1111*c* at the bottom which protrudes out away from them the direction of open travel lanes. This anchor 1111*c* of the stand 1112 is made to be inserted through the Concrete Temporary Railing (Type K) barrier 1111. The stand 1112 is then secured in place with a lock pin 1111*d*.

Figure 12:
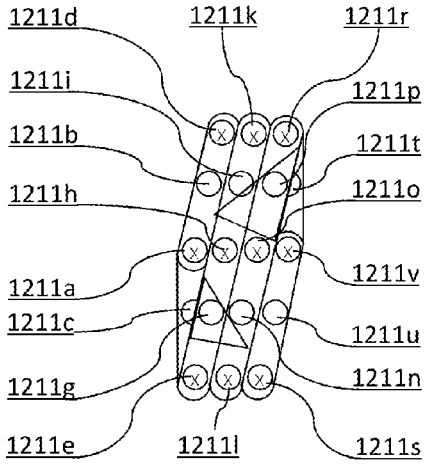
FIG. 12 depicts a front view of an expandable flashing arrow sign, and its relevant components, folded for travel or storage purposes, according to aspects of the present invention.

In another embodiment, the traffic sign according to aspects of the present invention is horizontally expandable. FIG. 12 depicts a front view of such an expandable flashing arrow sign in one embodiment in which both ends of its pieces are rounded. There are eight of these rounded pieces in this embodiment of the sign, four long and four short, although not all of the pieces are visible in FIG. 12. In this embodiment, the short pieces are a bit longer than half the length of the long pieces. When the sign is collapsed, two of the long pieces and two of the short pieces are fully visible. The two other short pieces are partially visible. FIG. 12 depicts the expandable sign in its fully collapsed position that is generally meant for either travelling or storage purposes. The lights 1211 are LED lights that are used for this embodiment, although not all of the twenty-two LED lights 1211 are visible from the front view when the sign is in its collapsed position. The LED lights 1211 used for this embodiment are thin enough to allow the sign to be fully collapsed (e.g., Mega-Bright PAR 36 LED's, commercially available from PSE911, for example at http:/ www.pse911.com/SHO-ME-Mega-Bright-LED-Arrow-Board-_p_562.html). Other lights may be used in place of the LED lights 1211 if desired, but thicker lights may hinder the sign's weight characteristics and ability to fully collapse. In this embodiment, the two long pieces visible in front have five lights 1211 on each. The two short pieces that are fully visible each have three lights 1211. The two partially visible short pieces have one light 1211. Other embodiments may include a different number or placement of lights 1211. This embodiment is transported on or in a truck or other vehicle, which allows multiple signs to be transported simultaneously, depending on the size of the vehicle transporting them.

Figure 13:
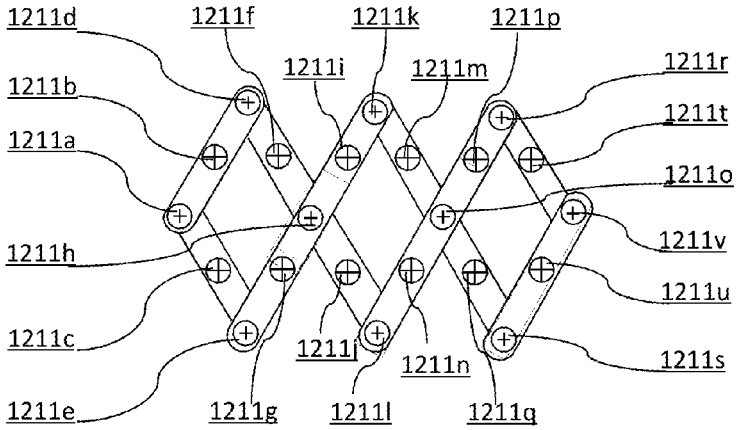
FIG. 13 depicts a front view of an expandable flashing arrow sign, and its relevant components, partially deployed for flashing arrow sign display, according to aspects of the present invention.

FIG. 13 depicts the expandable sign of FIG. 12 while in the state of being expanded horizontally. Only one person is required for expanding the sign. All LED lights 1211 are fully visible at this point in the sign's expansion. In this embodiment, the four pieces in front lean towards the right and the four pieces behind lean towards the left. In another embodiment, the pieces in front may lean left and the pieces in back may lean right. The two long pieces in front have five lights 1211 each and the two in back have two lights 1211 each in this embodiment. The two short pieces in front have three lights 1211 each on them and the two in back have one light 1211 each in this embodiment.

Figure 14:
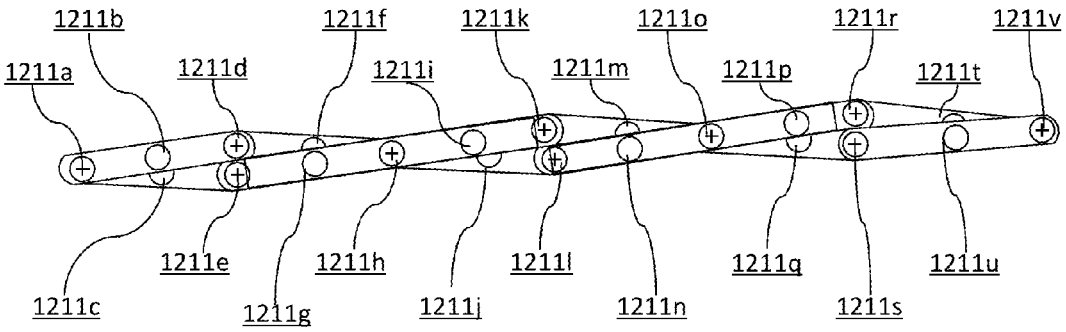
FIG. 14 depicts a front view of an expandable flashing arrow sign, and its relevant components, collapsed for travel or storage purposes, according to aspects of the present invention.

FIG. 14 depicts the expandable sign of FIG. 12 horizontally expanded to its fullest capability. In this position, the sign is expanded beyond that of its working position, but this position may be used as an alternative storage and travel configuration. When the sign is in this expanded position, some of the LED lights 1211 are no longer fully visible and only four of the pieces are fully visible with the other four partially visible. In this expanded position, the sign is longer horizontally than when it is in its other positions, but is shorter vertically.

Figure 15:
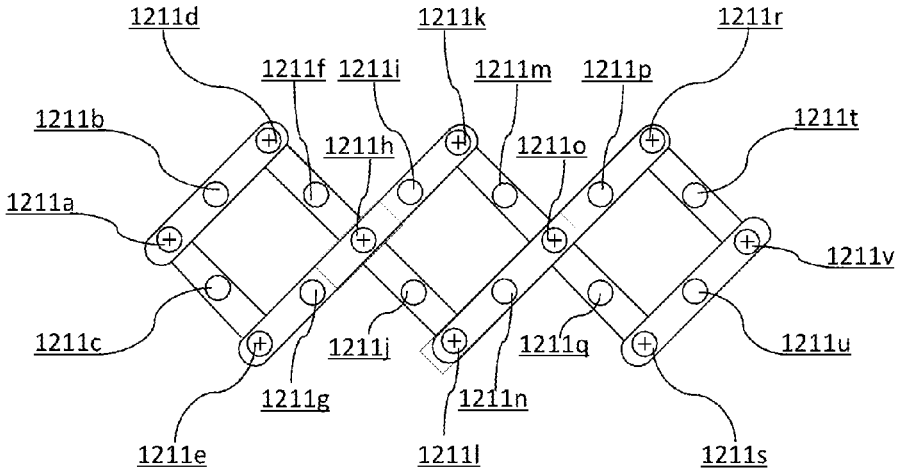
FIG. 15 depicts a front view of an expandable flashing arrow sign, and its relevant components, deployed for flashing arrow sign display, according to aspects of the present invention.

FIG. 15 depicts the normal working position of this embodiment of the expandable flashing arrow sign. The LED lights 1211 create a formation of three connected, equilateral diamonds. There are five rows and thirteen columns of lights 1211 on the sign, with the number of lights 1211 in each row and column varying. Once the sign is expanded to its working position, the sign must be secured in the desired location. This embodiment of the expandable arrow sign may be either magnetic or adhesive and therefore may not need a support like the various supports that the arrow boards of previous figures needed. In an embodiment where the arrow sign does not require a type 3 barricade, trailer, or other support, the expandable sign must be fixed onto an object of substantial size that is capable of securing the sign in the desired location at the desired height. One such object that may be used in some situations is a truck. The object used must be solid and tall enough for the sign to be placed at the desired height while providing an opaque backing surface to maximize contrast and visibility of the arrow signal lights. In addition to acting as a stand, the object that the sign is placed on also acts as a barrier preventing light from behind the sign from penetrating through and therefore potentially confusing drivers. There are no air vents included in the embodiments depicted in FIGS. 12, 13, 14, and 15 because the sign by design allows air to flow through. However, air vents may sometimes be included in some embodiments, depending on the requirements of each particular implementation.

Figure 16:
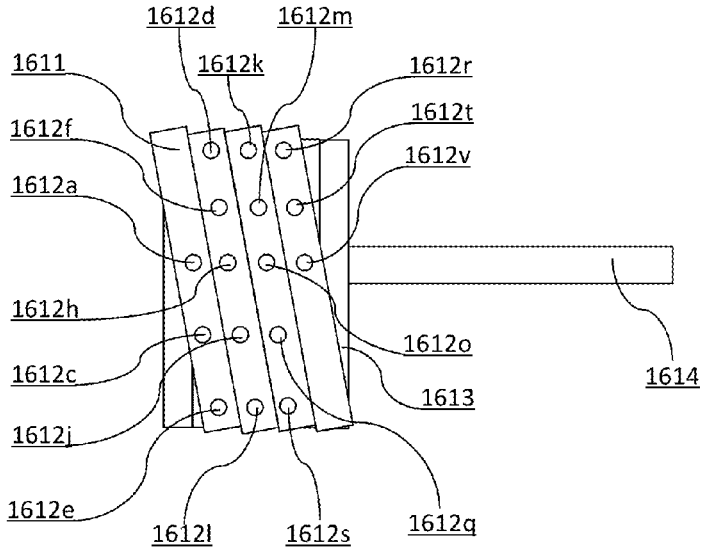
FIG. 16 depicts a front view of an expandable flashing arrow sign, and its relevant components, collapsed for travel or storage purposes, according to aspects of the present invention.

FIG. 16 depicts another embodiment of the expandable arrow sign according to aspects of the present embodiment, in which both edges of the pieces 1611 are flat. The flashing arrow sign consists of eight rectangular pieces 1611, although only the four front pieces 1611 which are leaning to the left may be easily perceived while the sign is collapsed. In this embodiment, bar 1614 provides a backing for the other parts of the sign to slide out on. The connected panels 1613 provide a curtain behind the arrow sign. The panels 1613 are in front of the bar 1614 in this embodiment although they may be placed behind the bar 1614 in other embodiments. This curtain is necessary for providing an opaque backing surface to maximize contrast and visibility of the arrow signal lights blocking light from behind the sign that may otherwise be able to penetrate through the sign and potentially confuse drivers. With this curtain, the arrow sign has an appearance similar to that of the traditional rectangular traffic sign when expanded. Only sixteen of lights 1612 are visible when collapsed in this embodiment. This particular embodiment of the flashing arrow sign uses LED lights 1612 that are thin enough to allow the sign to be collapsed. Other lights may be used instead, but thicker lights may hinder the signs ability to collapse. Air vents are not necessary for this embodiment because this embodiment by design already allows air to freely flow through the sign. However, air vents may be included in the sign, depending on the requirements of each particular implementation. This embodiment is transported on or in a truck or other vehicle, which allows multiple signs to be transported simultaneously, depending on the size of the vehicle transporting them.

Figure 17:
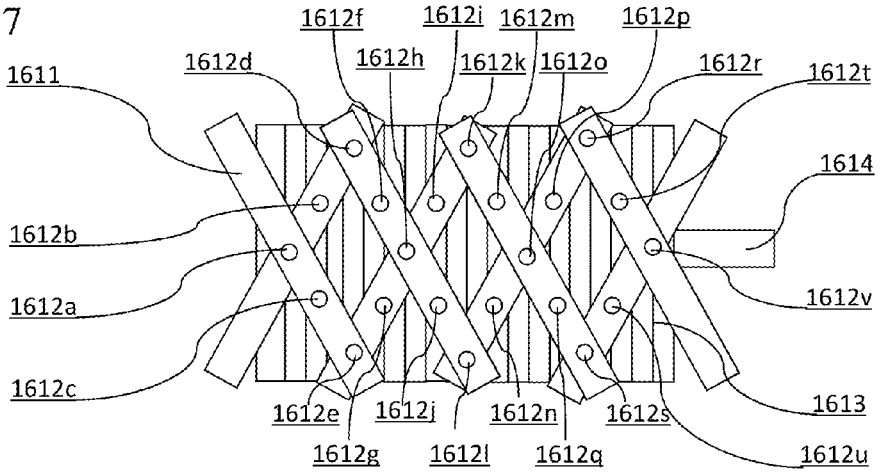
FIG. 17 depicts a front view of an expandable flashing arrow sign, and its relevant components, partially deployed for flashing arrow sign display, according to aspects of the present invention.

FIG. 17 shows the embodiment of FIG. 16 as it is being horizontally expanded. The pieces 1611 are being expanded to the right. The panels 1613 are simultaneously being horizontally expanded, which creates the curtain behind the lights 1612 on pieces 1611. The panels 1613 are continuously covering more of the bar 1614 as they are being expanded. All of the eight pieces 1611 are now perceivable. The four pieces 1611 in the front lean toward the left, and the four pieces 1611 behind them lean toward the right in this embodiment. In other embodiments, the four pieces 1611 in front may lean toward the right and the four pieces 1611 behind them may lean toward the left. All lights 1612 are now visible at this point in the expansion of the sign. This embodiment of the expandable sign requires only one person to handle its expansion.

Figure 18:
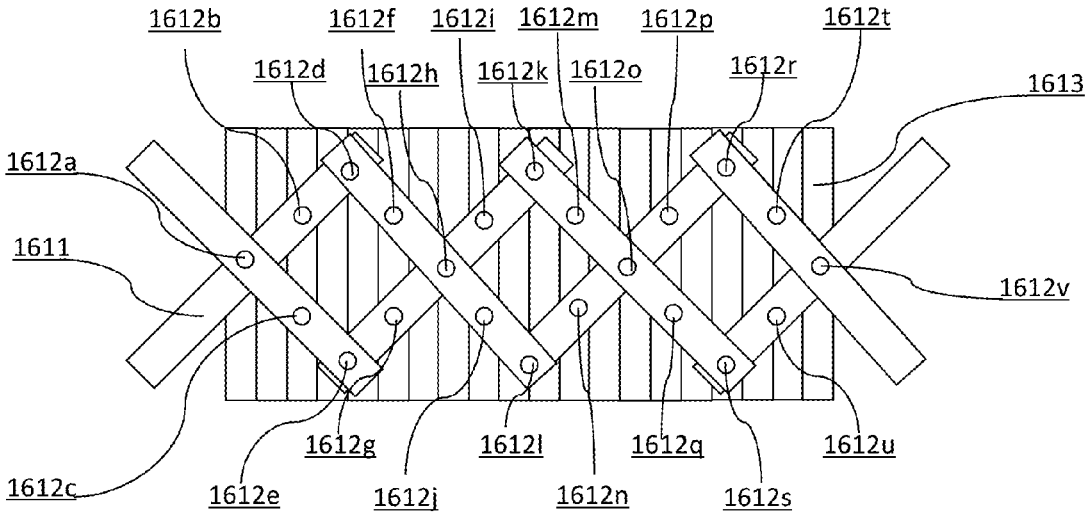
FIG. 18 depicts a front view of an expandable flashing arrow sign, and its relevant components, deployed for flashing arrow sign display, according to aspects of the present invention.

FIG. 18 depicts the embodiment of FIG. 16 in its working position where it is fully expanded. This embodiment does not expand past its working position, but other embodiments may if the bar 1611 is long enough to allow further expansion. The panels 1613 are also fully expanded. They create a solid curtain blocking light from the back from penetrating through the sign to the front and possibly confusing the drivers. Because of the curtain, the bar 1614 across the back as seen in FIGS. 16 and 17 is no longer visible from the front. In other embodiments, the bar may be in front of the panels 1613 and can therefore still mostly be seen from the front even when the sign is fully expanded or the bar may be longer than is necessary for the working position. The LED lights 1612 form equilateral diamonds. In this embodiment, there are five rows and thirteen columns of lights 1612, although the numbers of lights 1612 in each column or row vary. Other configurations of the LED lights 1612 may also be used as required. In FIG. 18, the pieces 1611 that the lights 1612 are placed on are all the same length, resulting in the four end pieces 1611 extending further than is necessary for the lights 1612, therefore leaving spaces with no lights 1612 on one end each on the pieces 1611. However, this embodiment is not limited to a configuration with the material extending past what is necessary for the lights 1612 as it does in FIG. 18. Lights 1612 may be placed further on the pieces 1611, or four end pieces 1611 may be cut shorter. Various embodiments of this expandable sign may require an embodiment of the type 3 barricades such as the one in FIGS. 4 and 6 to hold it, an embodiment of the traditional trailer to hold it, or it may have magnetic or adhesive material to allow it to stick onto a truck or other object of substantial size.

FIG. 19 depicts a closer front and side view of a locking device 414 from FIGS. 4 and 6 according to certain embodiments, locked in its closed position. This locking device may be used for opening and closing arrow board signs or portable changeable message signs in certain embodiments. When the lock 414 is in the closed position depicted in FIG. 19, the sign is folded down. The handle 1912 on the lock 414 must be pressed down to allow the lock 414 and, therefore the arrow board 412, to begin to rotate. While the sign is being unfolded, the lock mechanism 1911 locks two times. Locking mechanism 1911 locks at approximately 30 degrees as a preventative measure against accidents such as the sign collapsing down and possibly smashing down on the installers' fingers or causing other possible injury or property damage. The handle 1912 is then pressed a second time to unlock it and allow the lock 414 and board 412 to rotate further. Locking mechanism 1911 locks a second time when it is fully extended at approximately 180 degrees. This therefore totals three positions in which the locking devices 414 lock. The three positions where the lock 414 locks include when the sign is in the storage or travel position, when opened to approximately 30 degrees, and when fully extended to its working position. FIG. 19A also depicts two enlarged ends for structural integrity and additional welded support material 1913 located at each end of the locking device 414. These may be used for connecting the locking device 414 into the support frame 413.

FIG. 20 illustrates a closer front and side look at the locking device 414 used in FIGS. 4 and 6 according to certain embodiments, fully extended at approximately 180 degrees. When the locking device 414 on the sign is in this open position, the board 412 is deployed in its working position depicted in FIG. 6. In order to close the locking device 414 to return the board 412 to its travel and storage position, the handle 1912 must be pressed down first. The locking mechanism 1911 locks at approximately 30 degrees as a preventative measure against the sign accidentally smashing as it is being closed and potentially causing damage or injury. The handle 1912 must then be pressed a second time before the lock 414 can be closed further. The locking mechanism 1911 locks a final time when it is returned to its closed position as illustrated in FIG. 19. The lock 414 is in this position when the sign is folded for travel or storage. There is therefore a total of three locking positions, when the sign is opened to its working position, when partially opened at 30 degrees, and when the sign is closed in its travel and storage position. FIG. 20A also depicts two enlarged ends for structural integrity and additional welded support material 1913 located at each bottom end of the locking device 414. These enlargements 1913 may be used for connecting the locking device into the support frame by welding or other fastening method 413. Locking devices such as those depicted in FIGS. 19 and 20 are known in the art and commercially available. Although the arrow board signs and portable changeable message board signs which use support frame 413 are depicted as using locking device 414 to be able to fold and unfold, other embodiments may use other suitable locking devices instead, depending on the requirements of each particular implementation.

FIG. 21 depicts a front and side view of one of the feet 416 that the support frame 413 of the type 3 barricade in FIGS. 4 and 6 is inserted into when being set-up. FIG. 21A depicts a side view of the foot 416 with two vertical components, 2111 and 2112 and a horizontal component 2113. There is also a piece 2114 nested between components 2111 and 2112. Piece 2114 is centered on component 2113. Vertical components 2111 and 2112 are connected to the horizontal component 2113. Each horizontal component 2111 and 2112 is on one edge of piece 2114 and protrudes upwards. In this embodiment, in order to connect the two feet 416 to the support frame 413 of the type 3 barricade, each bottom end of the support frame 413 is placed into one foot 416 each, between the components 2111 and 2112, and rests on piece 2114. FIG. 21B depicts a front view of one of the feet 416. Vertical component 2111 is visible, protruding from horizontal component 2113 in this view. As a preventative measure in case of an accident, the embodiment depicted in FIG. 21 is designed to "break away" if it should encounter a strong force for safety reasons. This "breakaway" ability allows the sign to slide out of the feet 416, which allows feet 416 to remain in their respective places instead of falling with the sign. The combined weight of the type 3 barricade and board 412 is sufficient under most normal conditions to lock the support frame 413 into the feet 416, although in some circumstances such as high winds, pins and/or sandbags may be required to further ensure safety.

Figure 22:
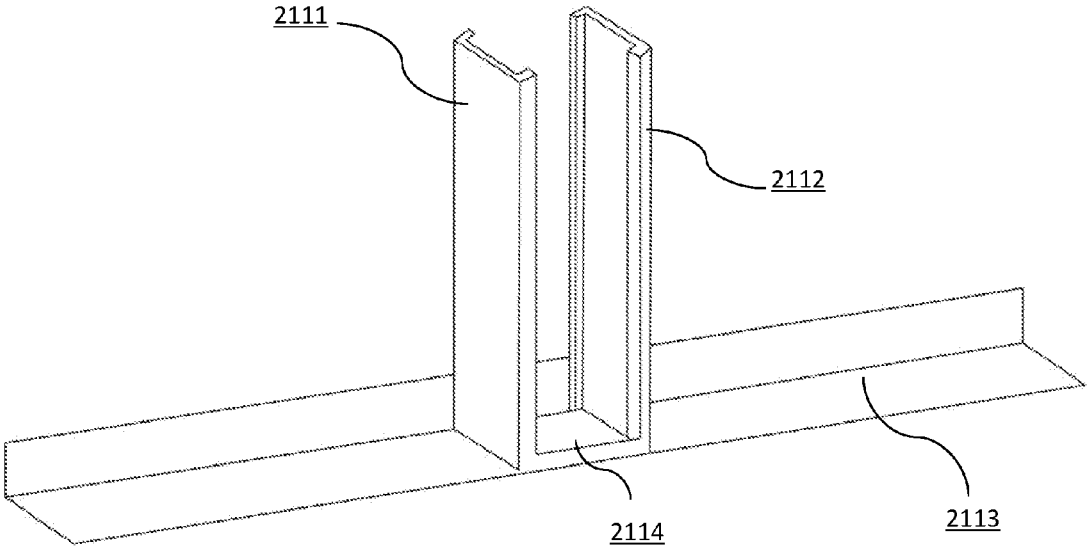
FIG. 22 depicts a three-dimensional view of the breakaway footing brackets used for the portable traffic signs, according to aspects of the present invention.

FIG. 22 depicts a three-dimensional view of the embodiment of one of the feet 416 in which components of the foot 416 can "breakaway" for safety reasons. Horizontal component 2113 provides a long base for the feet 416. The two short edges of horizontal component 2113 face the front and back of the overall sign. The other components are centered on component 2113. The vertical components 2111 and 2112 and their edges that point inward can be viewed more clearly in this view. If vertical components 2111 and 2112 did not have empty slots between their edges, they would create an open-ended, rectangular prism. To set up the support frame 413 into the feet 416, each bottom end of the support frame 413 is inserted into one of the feet 416, between the two vertical components 2111 and 2112. The bottom ends of the support frame 413 then rest on top of piece 2114. In other possible embodiments of the feet, a significant force such as a car hitting the sign may cause the feet to move with the sign as it falls. In this embodiment, the slots between the horizontal components 2111 and 2112 allow the sign to slide out of the feet 416, so the feet 416 can remain in place rather than falling along with the sign for safety reasons. Although this embodiment is generally designed to be used with the support frame 413 depicted in FIGS. 4 and 6, it may be also used with other embodiments of the support frame. The support frame 413 may also use other embodiments of the feet depending on the requirements of each particular implementation.

Figure 23:
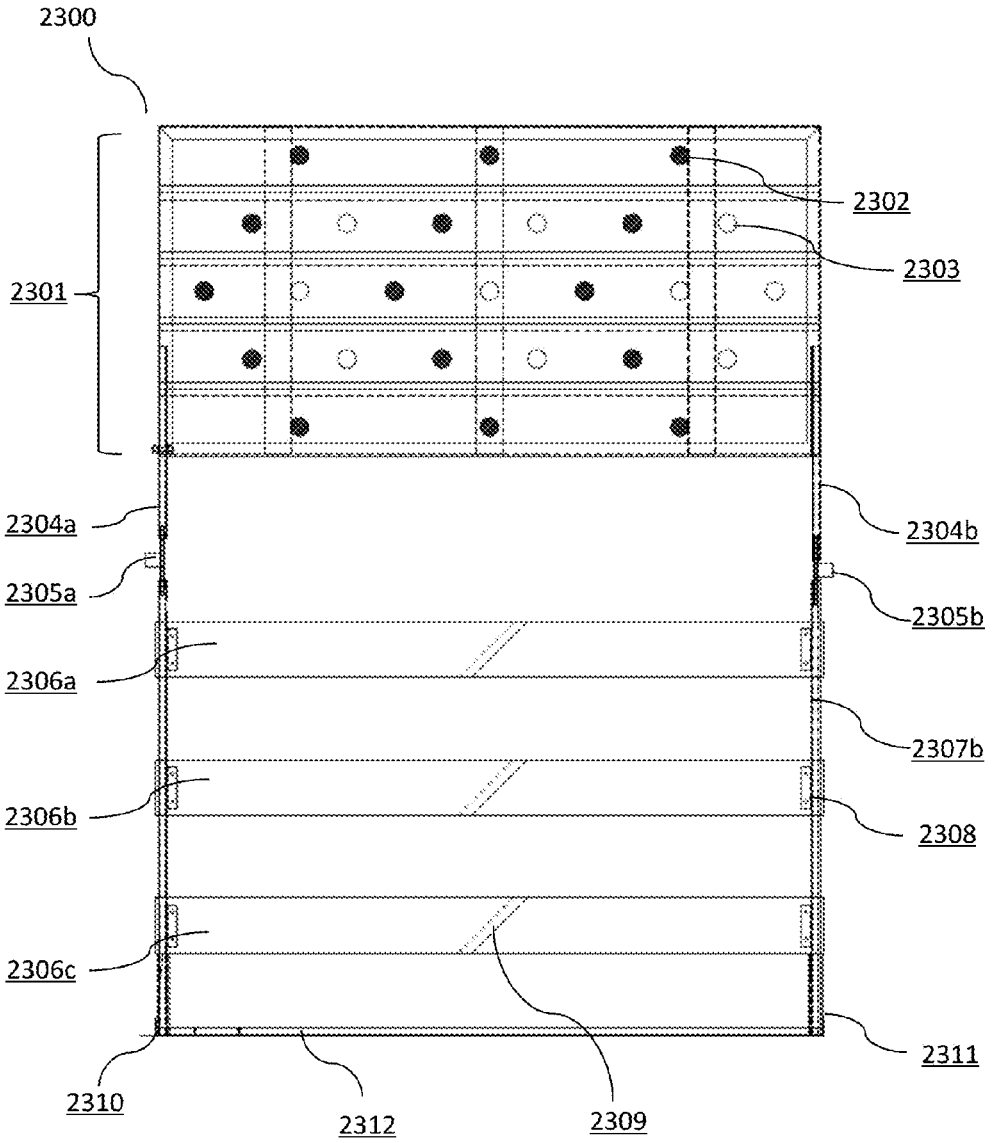
FIG. 23 depicts a front view of a portable combo flashing arrow sign, deployed for flashing arrow sign display, according to aspects of the present invention.

FIG. 23 depicts a front view of a portable combo flashing arrow sign 2300, configured with a flashing arrow board 2301, in its open position for flashing arrow sign display. As shown in FIG. 23, the portable combo flashing arrow sign 2300 has three horizontal panels 2306*a*, 2306*b* and 2306*c*, which can be made of plywood, metal, plastic or other suitable material. Each horizontal panel 2306*a*, 2306*b* and 2306*c* can have a reflective sheeting on the front side (i.e. toward oncoming traffic), and can have a predetermined breakaway or fracture path on the backside 2309, which makes the portable combo flashing arrow sign 2300 more crashworthy and safer in the event of a vehicle collision with the sign. The reflective sheeting, on the front side of the panels 2306*a*, 2306*b* and 2306*c*, enhances visibility, for traffic delineation purposes. The breakaway or fracture path 2309 is a predetermined plane of fracture on the panels 2306*a*, 2306*b* and 2306*c*. Alternatively, depending on the requirements of each particular configuration, the reflective sheeting may be included on either or both sides of the panels (so long as a sufficient amount faces oncoming traffic), and the breakaway or fracture path may be located on either or both sides of each panel.

The locking pivots 2305*a* and 2305*b* are shown in FIG. 23, in their open position, deployed for flashing arrow sign display. The portable combo flashing arrow sign 2300 has tube side frames 2307*a* and 2307*b*, attached to the locking pivots 2305*a* and 2305*b*. The horizontal panels 2306*a*, 2306*b* and 2306*c* are fixed to the tube side frames 2307*a* and 2307*b* with support brackets 2308 on each side of each panel. The airflow flashing arrow board 2301 is attached to tube side frames 2304*a* and 2304*b*, and is fixed to the locking pivots 2305*a* and 2305*b*. The portable combo flashing arrow sign 2300 can be made of aluminum, stainless steel, carbon steel, galvanized steel, plastic, wood, or other suitable light-weight material. The portable combo flashing arrow sign 2300 has two leg stands 2310 attached to each side frames 2307*a* and 2307*b*, each one encased into a male frame 2311. The two leg stands 2310 have a tube stabilizer bar 2312 made of aluminum, stainless steel, carbon steel, galvanized steel, plastic, wood, or other suitable material. FIG. 23 illustrates arrow board lights 2302 and 2303. This figure has 25 lights, but this is only illustrative. The type and amount of arrow board lights can vary.

Figure 24:
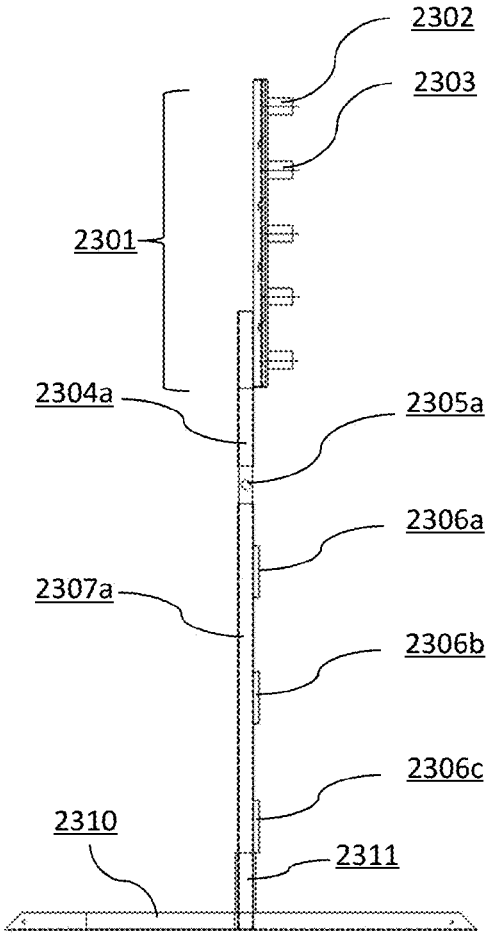
FIG. 24 depicts a left side view of a portable combo flashing arrow sign, deployed for flashing arrow sign display, according to aspects of the present invention.

The left side view of the portable combo flashing arrow sign 2300 is depicted in FIG. 24, in its open position for flashing arrow sign display. It shows how the airflow flashing arrow board 2301 is attached to a tube side frame 2304*a*, and is fixed to a locking pivot 2305*a*. The tube side frame 2307*a* is attached to a locking pivot 2305*a* in the upper side, and encased into a male frame 2311 in the bottom side. The male frame 2311 is fixed to a leg stand 2310. The panels 2306*a*, 2306*b* and 2306*c* are fixed to the side frame 2307*a*, as shown in FIG. 24.

Figure 25A:
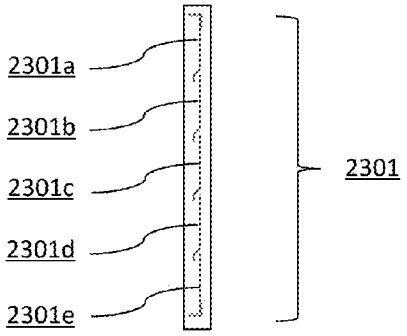
FIG. 25A depicts a left side view of an airflow flashing arrow board, according to aspects of the present invention.
Figure 25B:
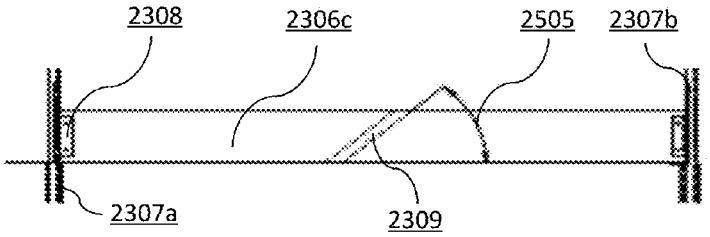
FIG. 25B depicts a rear view of a reflective board, with the predetermined breakaway fracture plane, according to aspects of the present invention.
Figure 25C:
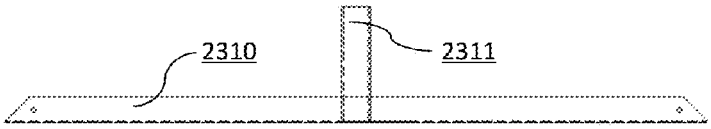
FIG. 25C depicts a left side view of a leg stand of a portable combo flashing arrow sign, according to aspects of the present invention.
Figure 25D:
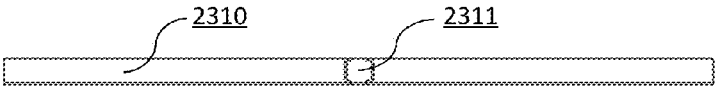
FIG. 25D depicts a top side view of the leg stand of a portable combo flashing arrow sign, according to aspects of the present invention.

FIG. 25A depicts the airflow flashing arrow board 2301, with five airflow panels 2301*a*, 2301*b*, 2301*c*, 2301*d* and 2301*e*. These, opaque airflow panels slidably mounted, can be made of aluminum, stainless steel, carbon steel, galvanized steel, plastic, wood, or other suitable material. Additional or fewer airflow panels may be included when required. FIG. 25B depicts the predetermined breakaway or fracture path 2309 on the panel 2306*c*. The standard angle 2505 of the breakaway or fracture path 2309 is 45 degrees, but this angle 2505 can vary depending on the material, width, or type of panel, according with impact and collision crashworthy required. FIG. 25C depicts a left side view of a leg stand 2310 attached to a male frame 2311 of a portable combo flashing arrow sign 2300; and FIG. 25D shows the top view of the leg stand 2310 attached to a male frame 2311, of a portable combo flashing arrow sign 2300.

Figure 26A:
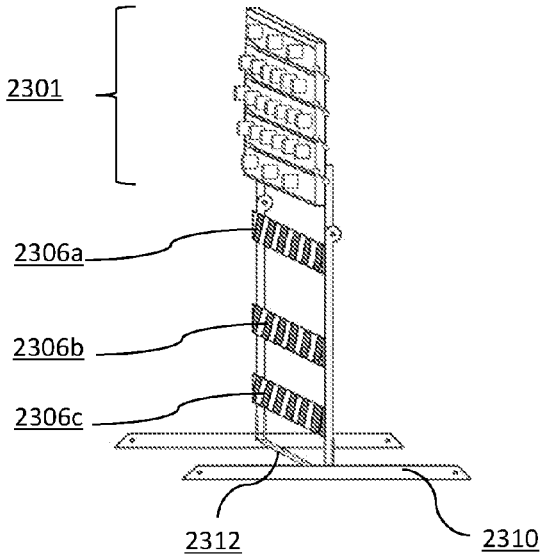
FIG. 26A illustrates a right perspective view of a portable combo flashing arrow sign, deployed for flashing arrow sign display, according to aspects of the present invention.
Figure 26B:
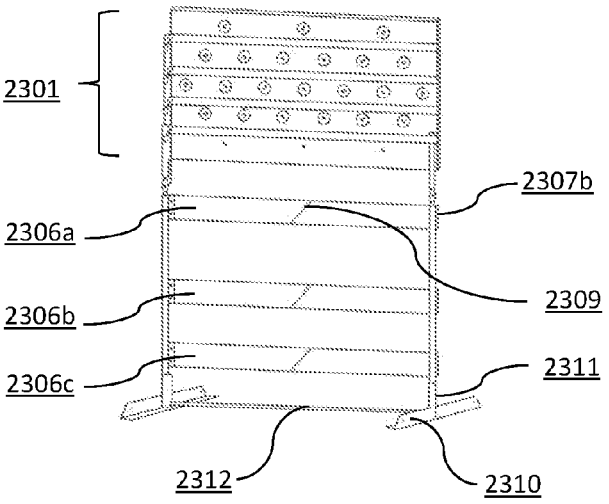
FIG. 26B illustrates a rear view of a portable combo flashing arrow sign, deployed for flashing arrow sign display, according to aspects of the present invention.

FIG. 26A illustrates a front view of a portable combo flashing arrow sign 2300, deployed for flashing arrow sign display, with the airflow flashing board 2301, and with all the lights 2302 switched on. Three horizontal panels with reflective sheeting 2306*a*, 2306*b* and 2306*c* are shown, attached to the side frames 2307*a* and 2307*b*, and encased into the male frames 2311 in bottom side. The male frames 2311 are fixed to the leg stands 2310. The two leg stands 2310 have a tube stabilizer bar 2312 in between. FIG. 26B illustrates a back perspective view of a portable combo flashing arrow sign 2300, deployed for flashing arrow sign display, with the airflow flashing board 2301, showing the rear side of the backing curtain, comprising a plurality of opaque airflow panels slidably mounted. The breakaway or fracture path 2309 is shown in FIG. 26B, and it is a predetermined plane of fracture on the panels 2306*a*, 2306*b*, and 2306*c*. These panels are shown, attached to the side frames 2307*a* and 2307*b*, and encased into a male frame 2311 in bottom side. The male frames 2311 are fixed to the leg stands 2310. The two leg stands 2310 have a tube stabilizer bar 2312 in between. Alternatively, depending on the requirements of each particular configuration, the reflective sheeting may be included on either or both sides of the panels (so long as a sufficient amount faces oncoming traffic), and the breakaway or fracture path may be located on either or both sides of each panel.

Figure 27A:
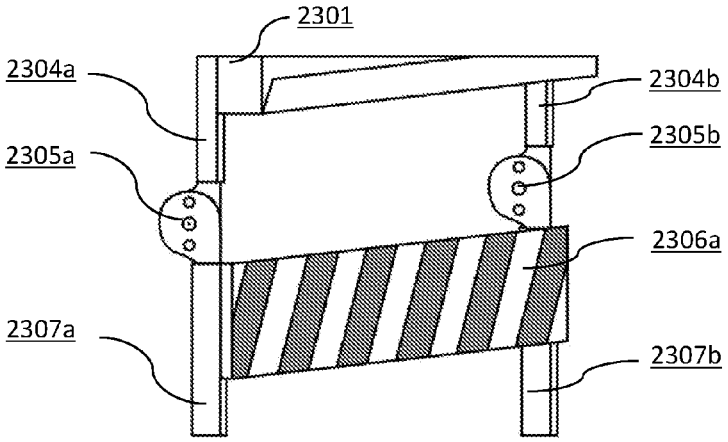
FIG. 27A illustrates a perspective detail view of the locking pivots of a portable combo flashing arrow sign, deployed for flashing arrow sign display, according to aspects of the present invention.
Figure 27B:
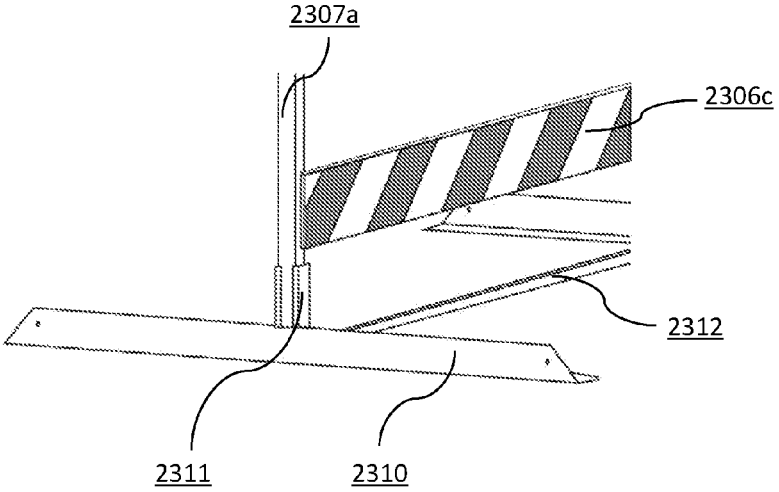
FIG. 27B illustrates perspective detail view of a leg stand and the stabilizer of a portable combo flashing arrow sign, according to aspects of the present invention.

As shown in FIG. 27A, the tube frames 2304*a* and 2304*b* are fixed at the upper side of the locking pivots 2305*a* and 2305*b*, and the tube frames 2307*a* and 2307*b* are fixed at the bottom side of the locking pivots 2305*a* and 2305*b*. The left side leg stand 2310 is depicted in FIG. 27B with the male frame 2311, and the stabilizer bar 2312 fixed to the leg stand 2310.

Figure 28:
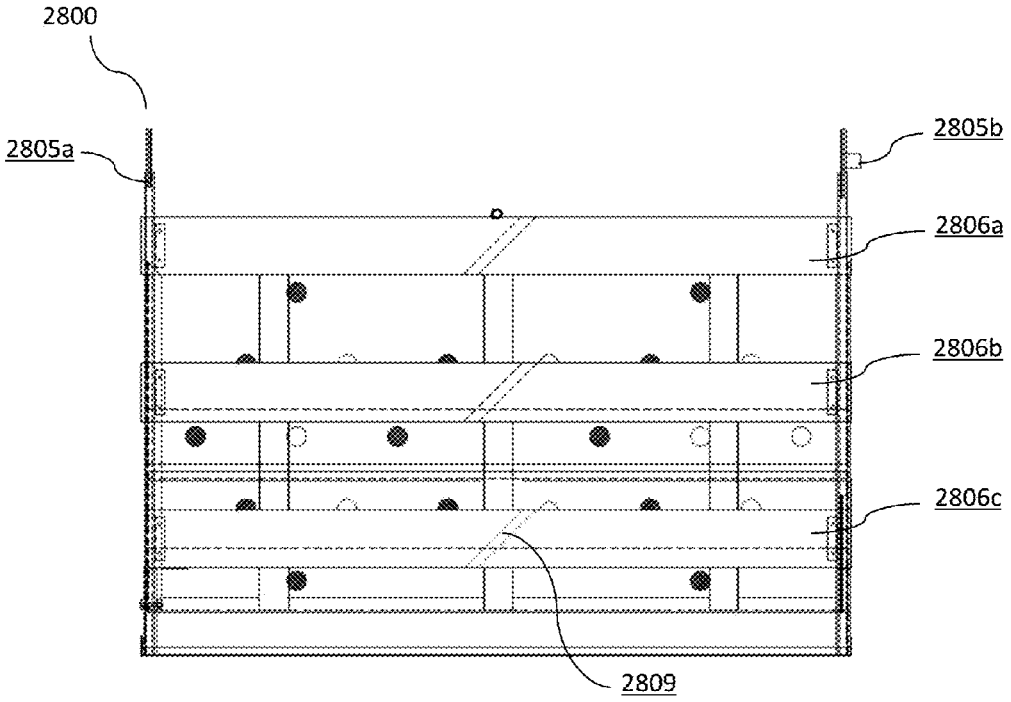
FIG. 28 depicts a front view of a portable combo flashing arrow sign, folded down for travel or storage purposes, according to aspects of the present invention.
Figure 29:
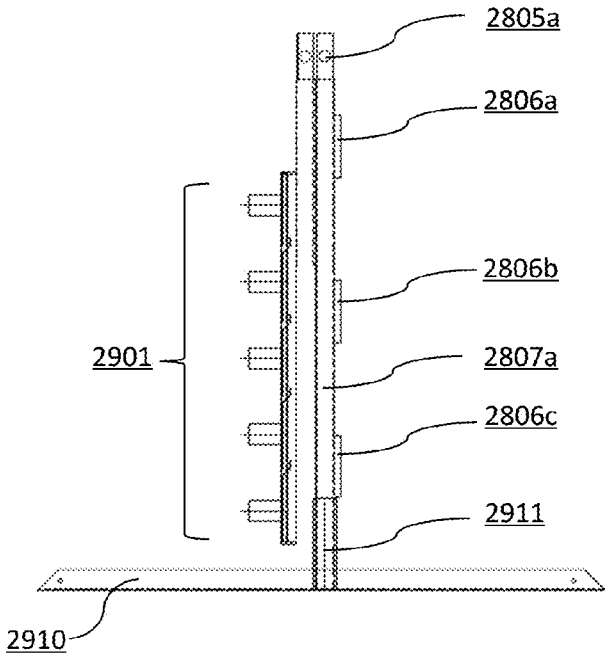
FIG. 29 depicts a left side view of a portable combo flashing arrow sign, folded down for travel or storage purposes, according to aspects of the present invention.
Figure 30A:
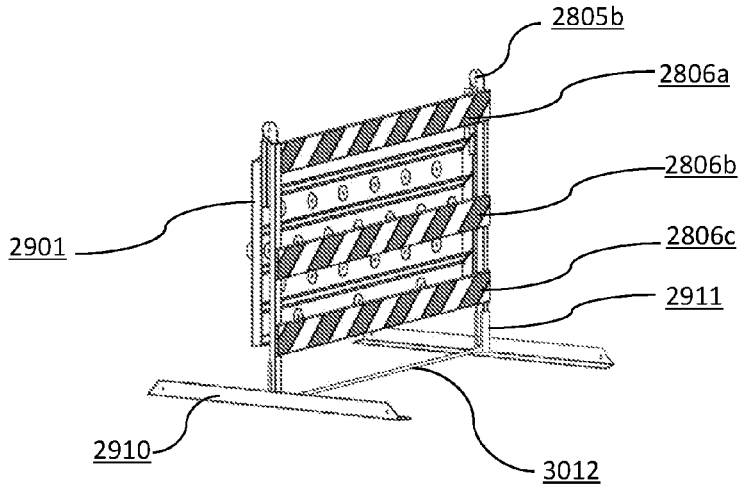
FIG. 30A illustrates a front perspective view of a portable combo flashing arrow sign, folded down for travel or storage purposes, according to aspects of the present invention.
Figure 30B:
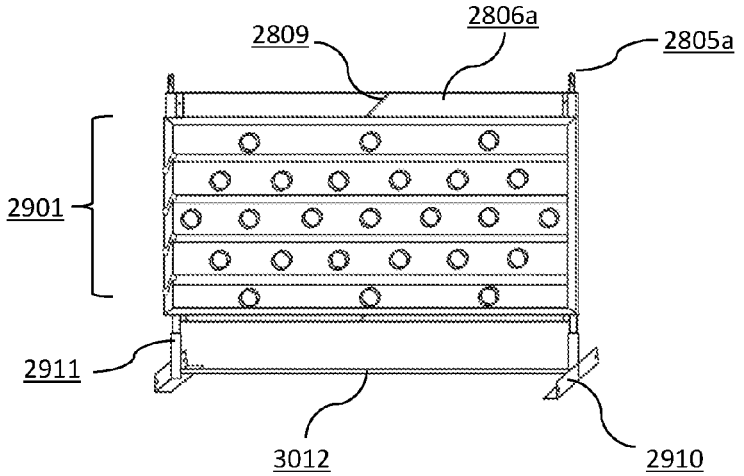
FIG. 30B illustrates a rear view of a portable combo flashing arrow sign, folded down for travel or storage purposes, according to aspects of the present invention.
Figure 31A:
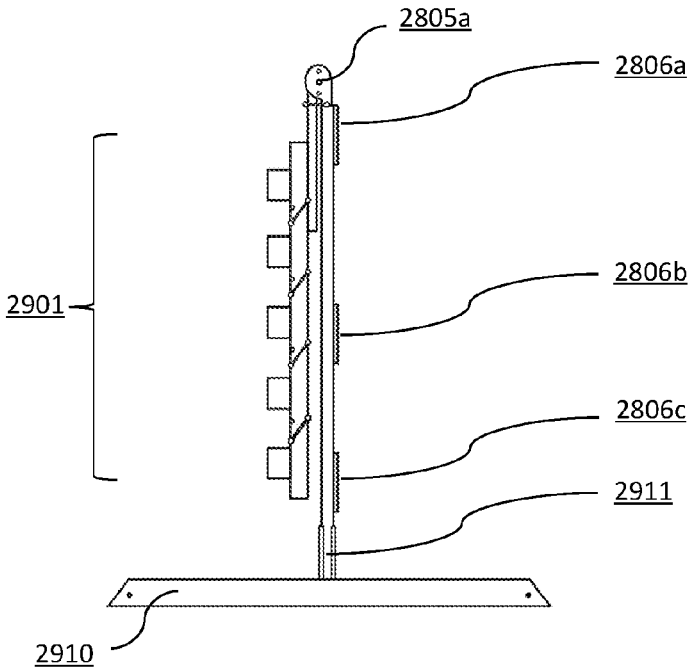
FIG. 31A illustrates a left side view of a portable combo flashing arrow sign, folded down for travel or storage purposes, according to aspects of the present invention.
Figure 31B:
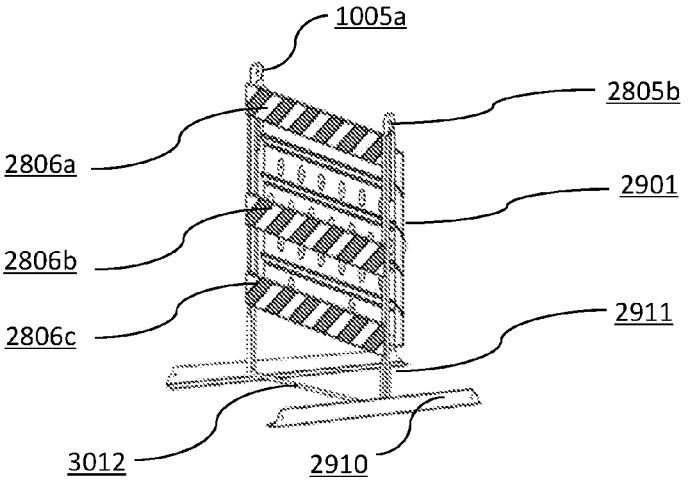
FIG. 31B illustrates a right perspective view of a portable combo flashing arrow sign, folded down for travel or storage purposes, according to aspects of the present invention.
Figure 32A:
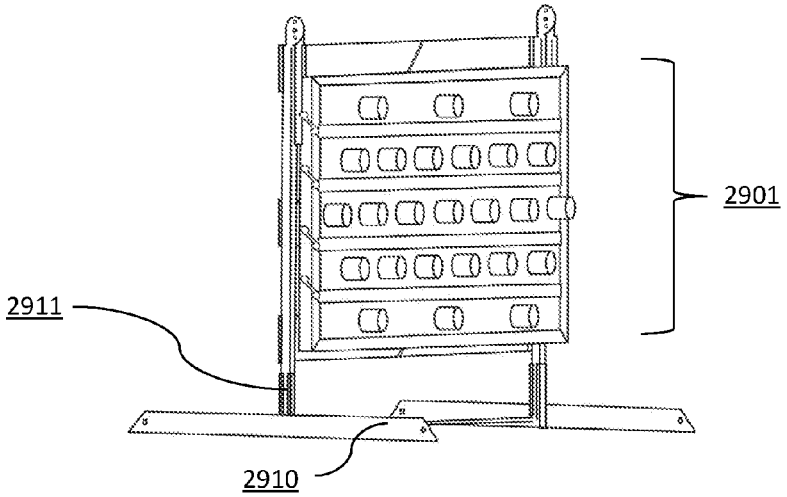
FIG. 32A illustrates a left back perspective view of a portable combo flashing arrow sign, folded down for travel or storage purposes, according to aspects of the present invention.
Figure 32B:
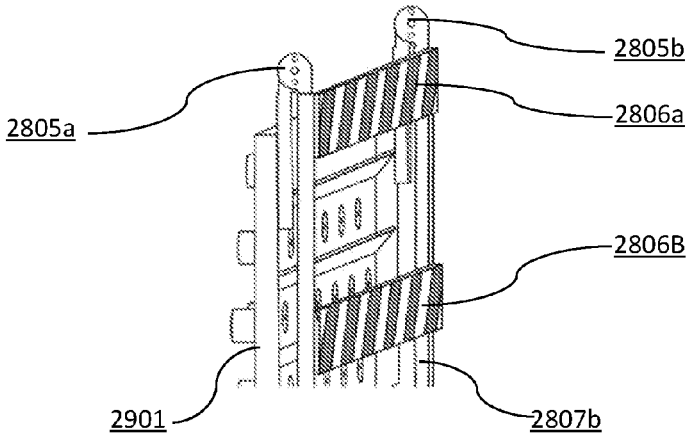
FIG. 32B illustrates a left perspective detail view of the locking pivots of a portable combo flashing arrow sign, folded down for travel or storage purposes according to aspects of the present invention.

A front view, of a portable combo flashing arrow sign 2800, folded down for travel or storage purposes, is shown in FIG. 28. It has three horizontal panels 2806*a*, 2806*b* and 2806*c*, with a reflective sheeting on the front side, and a predetermined breakaway or fracture path on the backside 2809, which makes the portable combo flashing arrow sign 2800 more crashworthy and safer in the event of a vehicle collision with this sign. Locking pivots 2805*a* and 2805*b* are shown in FIG. 28, in their closed position. A left side view, of a portable combo flashing arrow sign 2800, folded down for travel or storage purposes, is shown in FIG. 29. It illustrates the three horizontal panels 2806*a*, 2806*b* and 2806*c*, and a locking pivot 2805*a*, in its closed position. The airflow flashing arrow board 2901 is also folded down, the tube side frame 2807*a* is attached to a locking pivot 2805*a* in the upper side, and encased into a male frame 2911 in the bottom side. The male frame 2911 is fixed to a leg stand 2910. FIG. 30A illustrates a front perspective view of a portable combo flashing arrow sign 2800, folded down for travel or storage purposes, with the airflow board 2901, and 3 horizontal panels with reflective sheeting 2806*a*, 2806*b* and 2806*c*. Also shown in FIG. 30A, the locking pivots 2805*a*, and 2805*b*; the leg stands 2910, the male frame 2911, and the stabilizer bar 3012. FIG. 30B illustrates a back view of a portable combo flashing arrow sign, folded down for travel or storage purposes, with the front view of an airflow board 2901; the back view of the horizontal panel 2806*a*, with the breakaway or fracture path 2809, the leg stands 2910, the male frame 2911, and the stabilizer bar 3012. A left side view, of a portable combo flashing arrow sign 2800, folded down for travel or storage purposes, is also illustrated in FIG. 31A. It depicts three horizontal panels 2806*a*, 2806*b* and 2806*c*, a locking pivot 2805*a*, in its closed position. The airflow flashing arrow board 2901 is also folded down. The male frame 2911 is fixed to a leg stand 2910. FIG. 31B illustrates a right perspective view of a portable combo flashing arrow sign, folded down for travel or storage purposes. Also shown are three horizontal panels with reflective sheeting 2806*a*, 2806*b* and 2806*c*, locking pivots 2805*a*, 2805*b*, leg stands 2910, the male frame 2911, and the stabilizer bar 3012. FIG. 32A illustrates a left perspective back view of a portable combo flashing arrow sign, folded down for travel or storage purposes. Also shown are the airflow flashing arrow board 2901, folded down, and the male frame 2911, fixed to a leg stand 2910. FIG. 32B illustrates a perspective view of the locking pivots 2805*a* and 2805*b* of a portable combo flashing arrow sign, folded down for travel or storage purposes.

Figures 33A, 33B:
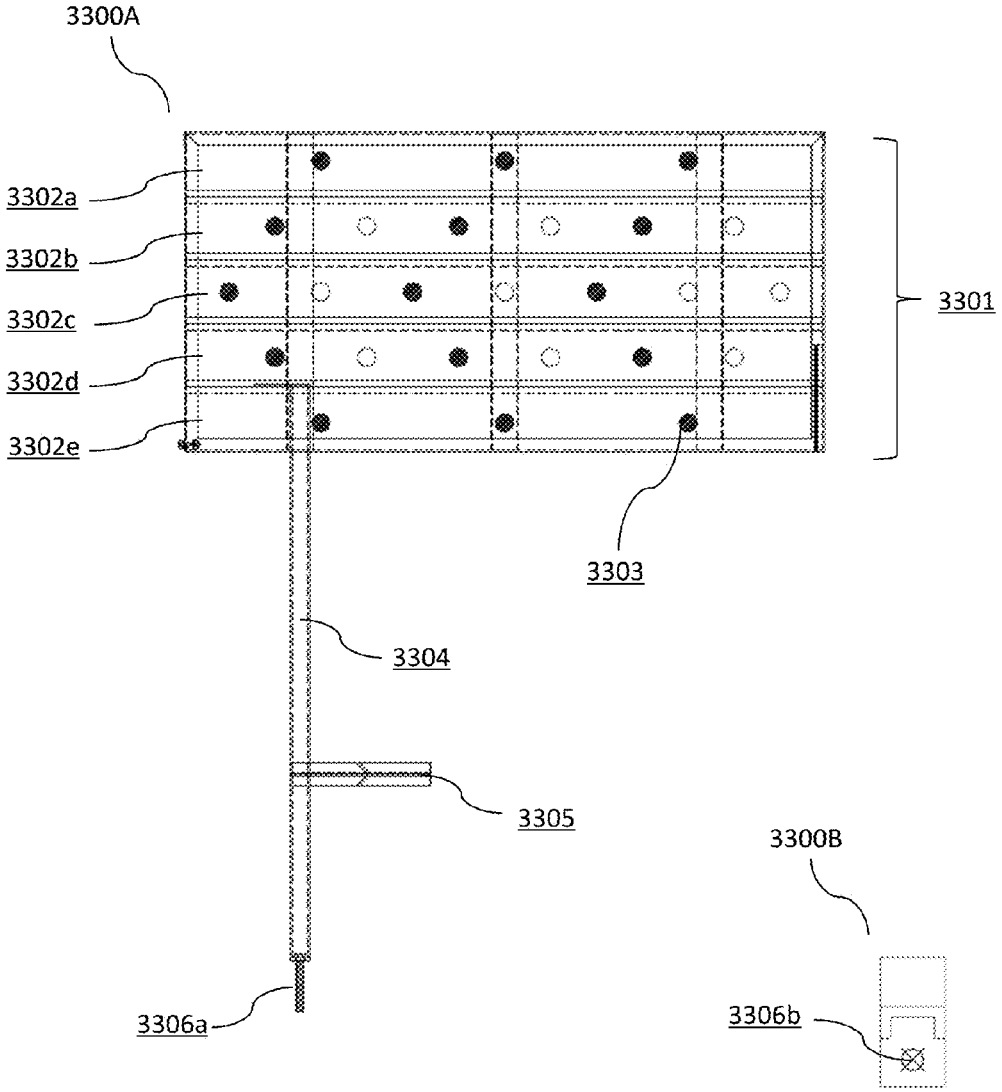
FIG. 33A depicts a front view of a portable K rail sign, deployed for flashing arrow sign display, according to aspects of the present invention.
FIG. 33B depicts a top view of a base plate of a portable K rail sign, according to aspects of the present invention.
Figure 34A:
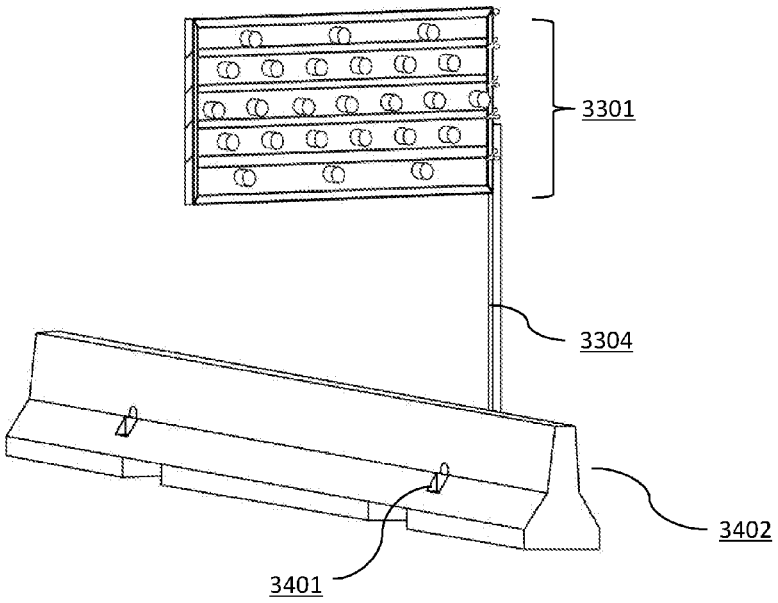
FIG. 34A illustrates a front perspective view of a portable K rail sign, installed on a concrete road barrier, and deployed for flashing arrow sign display according to aspects of the present invention.
Figure 34B:
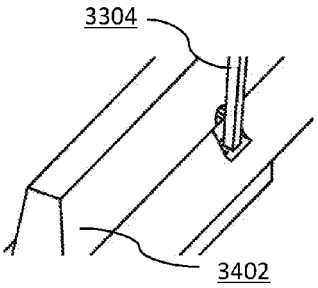
FIG. 34B illustrates a top perspective detail view of the leg stand of a portable K rail sign, installed on a concrete road barrier, and deployed for flashing arrow sign, according to aspects of the present invention.
Figure 34C:
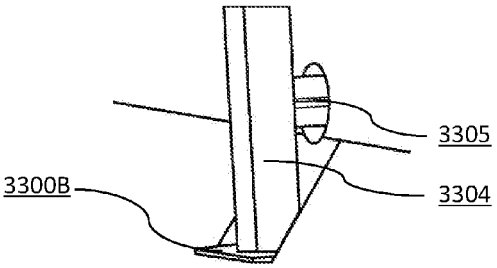
FIG. 34C illustrates a side detail view of the leg stand and base plate of a portable K rail sign, installed on a concrete road barrier, according to aspects of the present invention.

One embodiment is depicted in FIG. 33A in its open position for flashing arrow sign display. FIG. 33A is a front view of a portable K rail sign 3300A, configured with a flashing arrow board 3301 attached to one tube or channel frame 3304, which can be made of aluminum, stainless steel, carbon steel, galvanized steel, other metal, plastic or other suitable material. There is also an "L" bar 3305, fixed to the tube/channel frame 3304, to place the K rail sign 3300A into a concrete road barrier. The flashing arrow board 3301 has 25 flashing arrow lights 3303. The type and amount of arrow board lights 3303 can vary. FIG. 16B depicts a top view of a base plate 3300B of a portable K rail sign. FIG. 34A illustrates a front perspective view of a portable K rail sign 3300A, installed on a concrete road barrier 3402, and deployed for flashing arrow sign display. The leg stand frame 3304 is installed into the concrete road barrier holes 3401. FIG. 34B illustrates a top perspective detail view of the leg stand frame 3304 of a portable K rail sign 3300A, installed in a concrete road barrier 3402, and deployed for flashing arrow sign. FIG. 34C illustrates a side view of the leg stand frame 3304, the "L" bar 3305, and the base plate 3300B, of a portable K rail sign, installed into a concrete road barrier.

Figure 35:
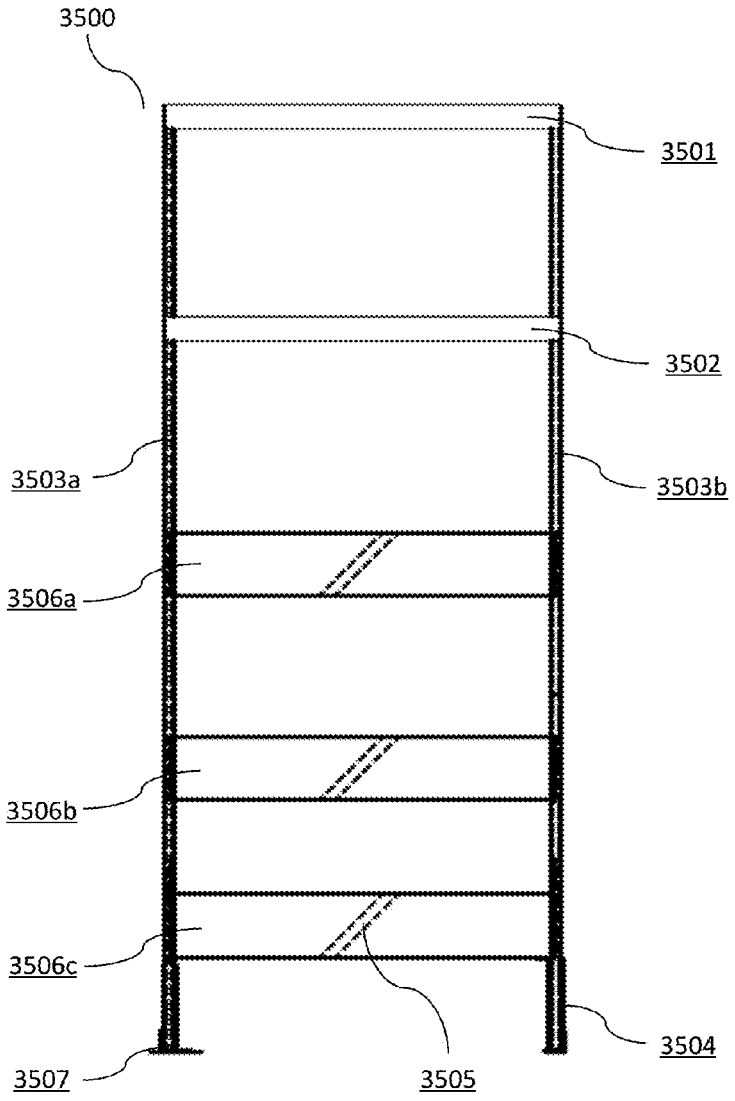
FIG. 35 depicts a front view of a crashworthy type 3 sign support, according to aspects of the present invention.

FIG. 35 depicts a front view of a crashworthy type 3 sign support 3500 in its open position for traffic arrow sign display. As shown in FIG. 35, the crashworthy type 3 sign support 3500 has three horizontal panels 3506*a*, 3506*b* and 3506*c*, which can be made of plywood, metal, plastic or other suitable material. Each horizontal panel 3506*a*, 3506*b* and 3506*c* can have a reflective sheeting on the front side, and can have a predetermined breakaway or fracture path on the backside 3505, which makes the crashworthy type 3 sign support 3500, crash safer in the event of a vehicle collision with the sign. The reflective sheeting, on the front side of the panels 3506*a*, 3506*b* and 3506*c*, enhances visibility, for traffic delineation purposes. The breakaway or fracture path 3505 is a predetermined plane of fracture on the panels 3506*a*, 3506*b* and 3506*c*. The frame is composed by a cross tube 3501, at the top section of the crashworthy type 3 sign support 3500, and a middle cross tube 3502, for road sign support. The crashworthy type 3 sign support 3500 has two tube side frames 3503*a* and 3503*b*, attached to the top cross tube 3501, to the middle cross tube 3502 and to the three reflective panels 3506*a*, 3506*b* and 3506*c*.

Figure 36:
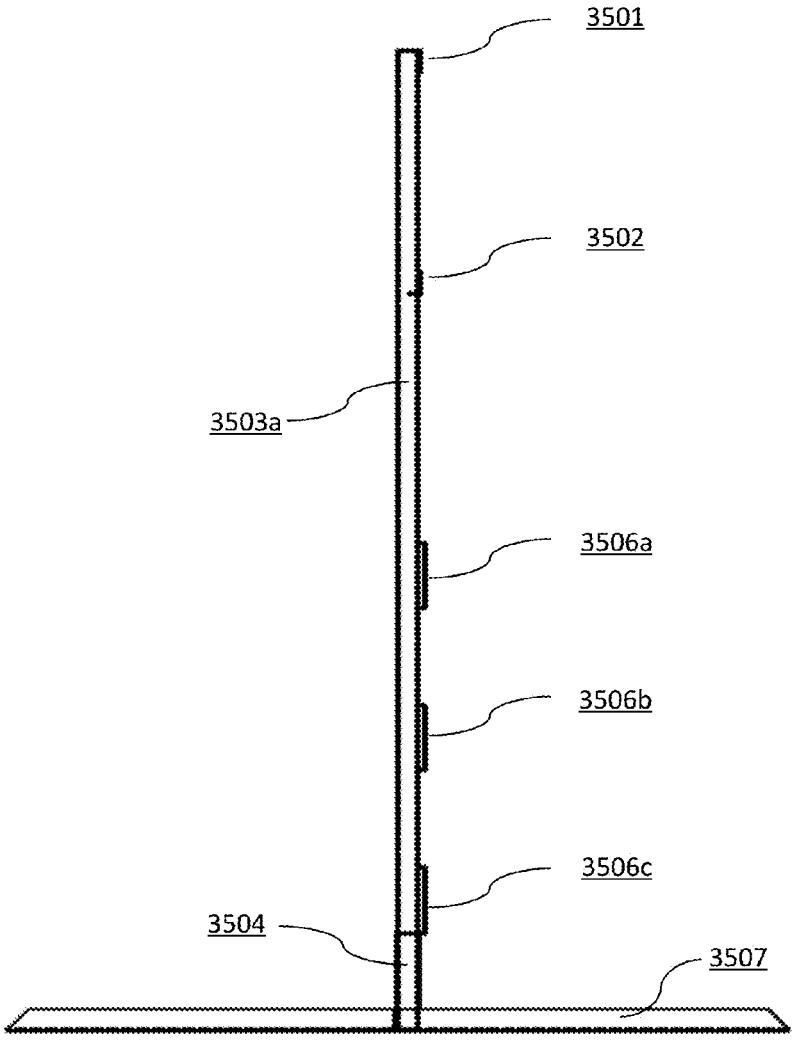
FIG. 36 depicts a left side view of a crashworthy type 3 sign support, according to aspects of the present invention.
Figure 37A:
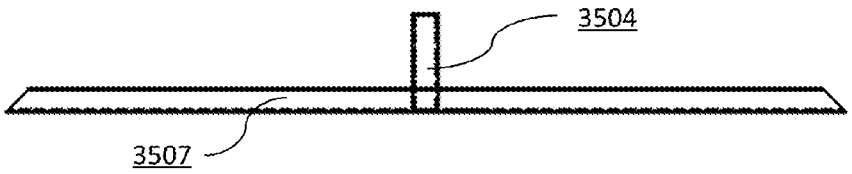
FIG. 37A depicts a top side view of a leg stand support of a crashworthy type 3 sign support, according to aspects of the present invention.
Figure 37B:
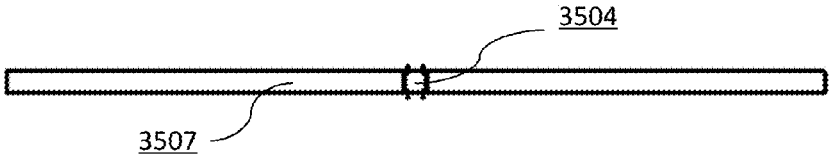
FIG. 37B depicts a side view of a leg stand support of a crashworthy type 3 sign support, according to aspects of the present invention.
Figure 38A:
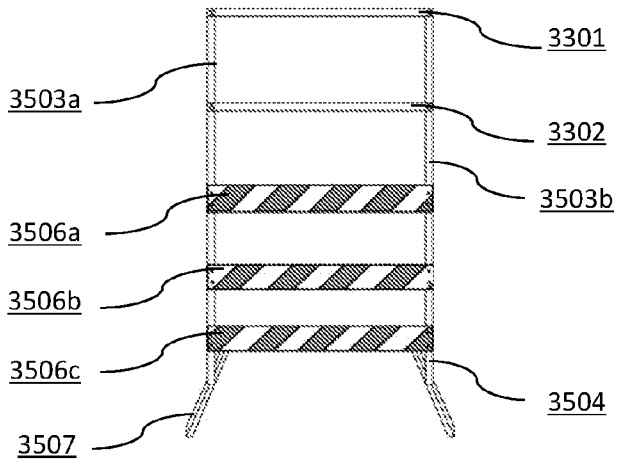
FIG. 38A illustrates a front view of a crashworthy type 3 sign support, according to aspects of the present invention.
Figure 38B:
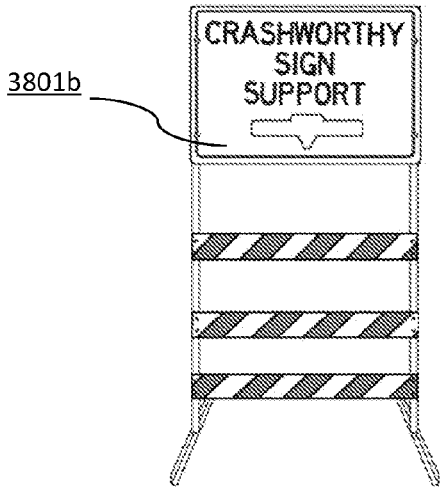
FIG. 38B illustrates a front view of a crashworthy type 3 support, with a sign attached to it, and deployed for traffic sign display, according to aspects of the present invention.

The left side view of a crashworthy type 3 sign support 3500 is depicted in FIG. 36, in its open position for traffic sign display. It shows how the tube side frame 3503*a* is fixed to a leg stand 3507. The panels 3506*a*, 3506*b* and 3506*c* are fixed to the side frame 3503*a*, as shown in FIG. 36. FIG. 37A depicts a left side view of a leg stand 3507 attached to a male frame 3504 of a crashworthy type 3 sign support 3500, and FIG. 37B shows the top view of the leg stand 3507 attached to a male frame 3504, of a crashworthy type 3 sign support 1900. FIG. 38A illustrates a front view of a crashworthy type 3 sign support 3500, with the 3 reflective panels 3506*a*, 3506*b*, and 3506*c*. Also FIG. 38A shows the leg stands 3507, the top cross tube 3501, the middle cross tube 3502 and the two tube side frames 3503*a* and 3503*b*. FIG. 38B illustrates a front view of a crashworthy type 3 support, with a traffic road sign 3801*b* attached to it.

Figure 39:
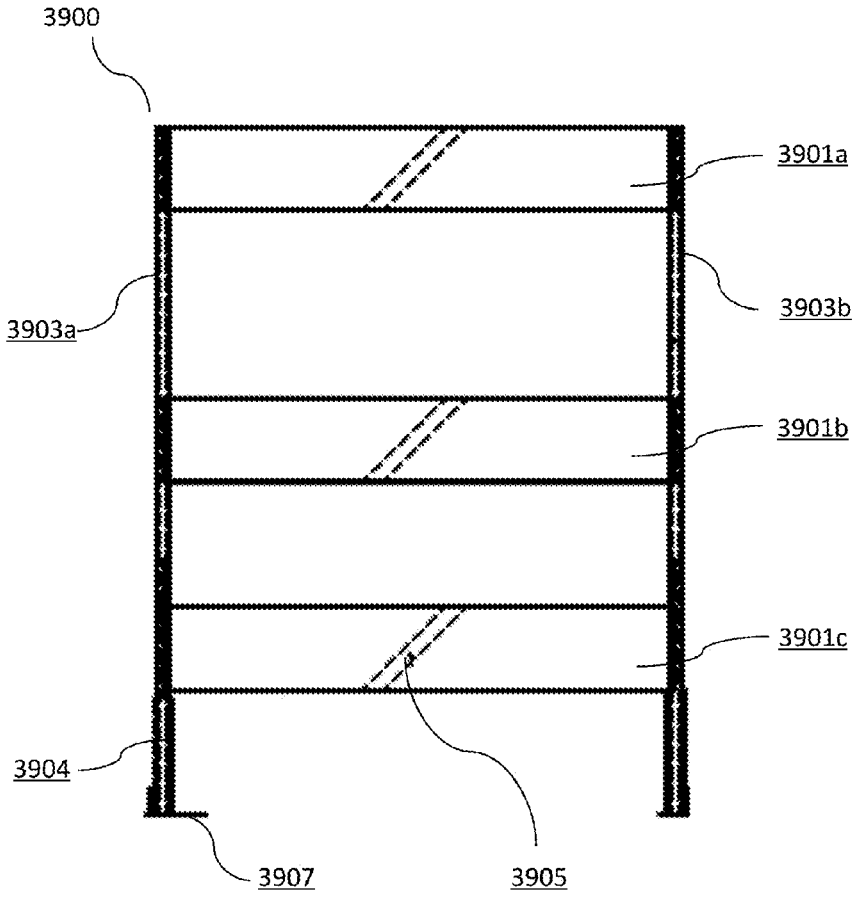
FIG. 39 depicts a front view of a crashworthy type 3 half barricade sign support, according to aspects of the present invention.

FIG. 39 depicts a front view of a crashworthy type 3 half barricade sign support 3900 in its open position for traffic sign display. As shown in FIG. 39, the crashworthy type 3 half barricade sign support 3900 has three horizontal panels 3901*a*, 3901*b* and 3901*c*, which can be made of plywood, metal, plastic or other suitable material. Each horizontal panel 3901*a*, 3901*b* and 3901*c* can have a reflective sheeting on the front side, and can have a predetermined breakaway or fracture path on the backside 3905, which makes the crashworthy type 3 half barricade sign support 3900, crash safer in the event of a vehicle collision with the sign. The reflective sheeting, on the front side of the panels 3901*a*, 3901*b* and 3901*c*, enhances visibility, for traffic delineation purposes. The breakaway or fracture path 3905 is a predetermined plane of fracture on the panels 3901*a*, 3901*b* and 3901*c*. The crashworthy type 3 half barricade sign support 3900 has two tube side frames 3903*a* and 3903*b*, attached to the three reflective panels 3901*a*, 3901*b* and 3901*c*.

Figure 40:
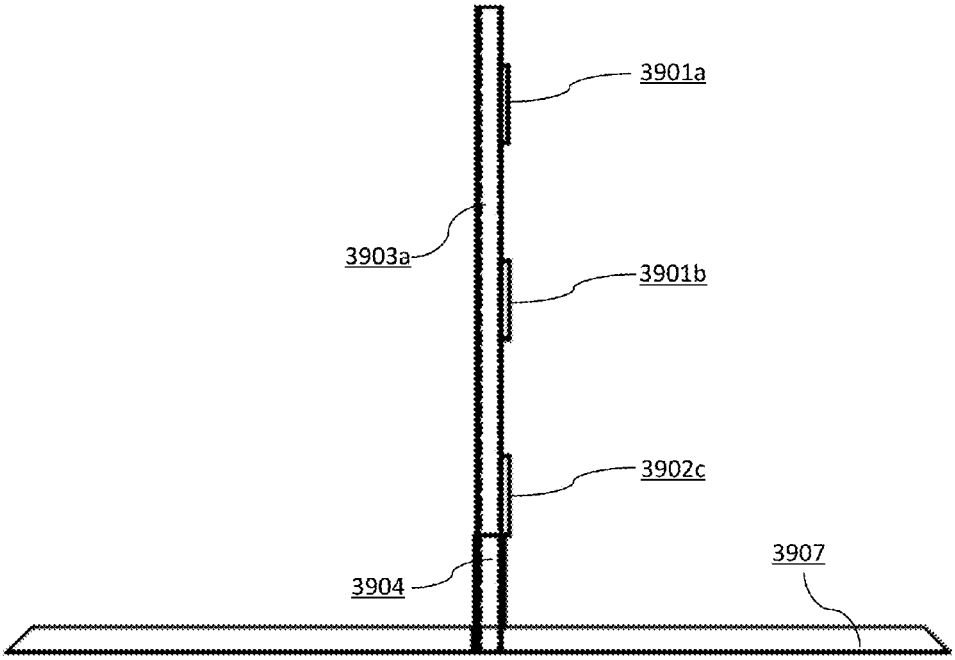
FIG. 40 depicts a left side view of a crashworthy type 3 half barricade sign support, according to aspects of the present invention.
Figure 41A:
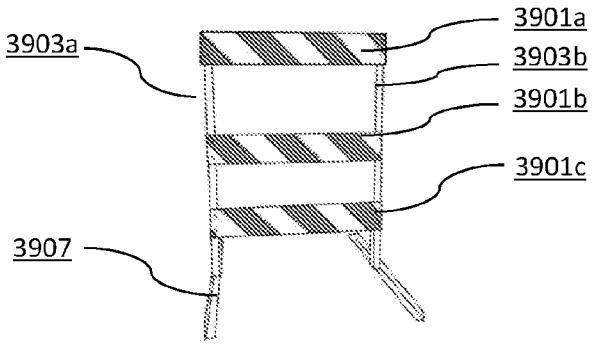
FIG. 41A illustrates a front view of a crashworthy type 3 half barricade sign support, according to aspects of the present invention.
Figure 41B:
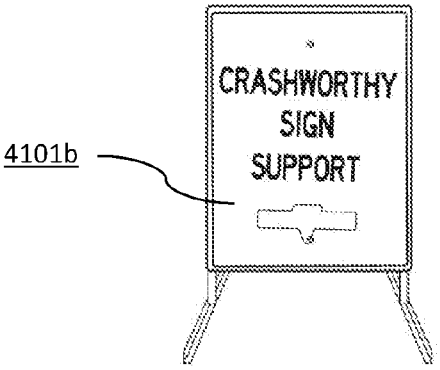
FIG. 41B illustrates a front view of a crashworthy type 3 half barricade support, with a sign attached to it, and deployed for traffic sign display, according to aspects of the present invention.

The left side view of a crashworthy type 3 half barricade sign support 3900 is depicted in FIG. 40, in its open position for traffic sign display. It shows how the tube side frame 3903*a* is fixed to a leg stand 3907. The panels 3901*a*, 3901*b* and 3901*c* are fixed to the side frame 3903*a*. FIG. 41A illustrates a front view of a crashworthy type 3 half barricade sign support 3000, with the 3 reflective panels 3901*a*, 3901*b*, and 3901*c*, the leg stands 3907, and the two tube side frames 3903*a* and 3903*b*. FIG. 41B illustrates a front view of a crashworthy type 3 half barricade support, with a traffic road sign 4101*b* attached to it.

While the above description contains many specifics and certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art, as mentioned above. The invention includes any combination or subcombination of the elements from the different species and/or embodiments disclosed herein.

I claim:

1. A portable combo flashing arrow sign for traffic control, comprising:

a flashing arrow board pivotably attached to a base portion, wherein said base portion comprises one or more horizontal panels, wherein each said horizontal panel comprises a breakaway path and traffic-facing reflective sheeting, and wherein said flashing arrow board comprises a plurality of light-containing panels that comprise an airflow path between at least some of said light-containing panels.

* * * * *